US011744431B2

(12) United States Patent
Johnson et al.

(10) Patent No.: US 11,744,431 B2
(45) Date of Patent: Sep. 5, 2023

(54) SURFACE CLEANING APPARATUS

(71) Applicant: BISSELL Inc., Grand Rapids, MI (US)

(72) Inventors: Steven M. Johnson, Hudsonville, MI (US); James Michael Preston, Grand Rapids, MI (US); Alan Finnie, Hudsonville, MI (US); Mitchell J. DeJonge, Fruitport, MI (US); Jason W. Pruiett, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/584,840

(22) Filed: Jan. 26, 2022

(65) Prior Publication Data

US 2022/0142445 A1 May 12, 2022

Related U.S. Application Data

(63) Continuation of application No. 16/812,809, filed on Mar. 9, 2020, now Pat. No. 11,540,693, which is a (Continued)

(51) Int. Cl.
*A47L 9/04* (2006.01)
*A47L 11/40* (2006.01)
(Continued)

(52) U.S. Cl.
CPC ..... *A47L 11/4094* (2013.01); *A47L 7/0014* (2013.01); *A47L 7/0038* (2013.01);
(Continued)

(58) Field of Classification Search
CPC ..... A47L 11/40; A47L 11/4094; A47L 11/18; A47L 11/19; A47L 11/185; A47L 11/34;
(Continued)

(56) References Cited

U.S. PATENT DOCUMENTS 4,589,161 A 5/1986 Kochte et al.
6,533,871 B2 3/2003 Zahuranec et al.
(Continued)

FOREIGN PATENT DOCUMENTS

CN 202437018 U 9/2012
GB 2599801 A 12/2016
(Continued)

OTHER PUBLICATIONS

Intellectual Property Office, Combined Search Report and Examination Report under Sections 17 and 18(3) re corresponding Application No. GB2114091.8, dated Feb. 8, 2022, 4 pages, South Wales, NP.

(Continued)

*Primary Examiner* — Robert J Scruggs
(74) *Attorney, Agent, or Firm* — Quinn IP Law

(57) ABSTRACT

A surface cleaning apparatus is provided with a base assembly, an upright assembly, and a fluid recovery system. The base assembly includes a base housing, a brush chamber, at least one brushroll in the brush chamber; and a removable brush housing. A portion of the brush chamber is removable with the brush housing.

20 Claims, 27 Drawing Sheets

Related U.S. Application Data continuation of application No. 15/841,666, filed on Dec. 14, 2017, now Pat. No. 10,602,903.

(60) Provisional application No. 62/435,120, filed on Dec. 16, 2016.

(51) Int. Cl.

| | |
|---|---|
| ***A47L 11/34*** | (2006.01) |
| ***A47L 7/00*** | (2006.01) |
| ***A47L 11/18*** | (2006.01) |
| *A47L 5/32* | (2006.01) |

(52) U.S. Cl.

CPC ..... *A47L 11/185* (2013.01); *A47L 11/34* (2013.01); *A47L 11/4016* (2013.01); *A47L 11/4041* (2013.01); *A47L 11/4044* (2013.01); *A47L 11/4083* (2013.01); *A47L 11/4088* (2013.01); *A47L 5/32* (2013.01); *A47L 9/0444* (2013.01)

(58) Field of Classification Search

CPC ..... A47L 11/4016; A47L 11/4036; A47L 11/4041; A47L 11/4044; A47L 11/408; A47L 11/4083; A47L 11/4088; A47L 7/00; A47L 7/0014; A47L 7/0038; A47L 5/32; A47L 9/0444

See application file for complete search history.

(56) References Cited

U.S. PATENT DOCUMENTS

| | | | | |
|---|---|---|---|---|
| 6,629,332 | B2 | 10/2003 | Morgan et al. | |
| 6,832,409 | B2 | 12/2004 | Morgan et al. | |
| 6,842,942 | B2 | 1/2005 | Morgan et al. | |
| 7,200,893 | B2 | 4/2007 | Gerber et al. | |
| 7,690,079 | B2 | 4/2010 | Boddy et al. | |
| 7,870,638 | B2 | 1/2011 | Jansen | |
| 8,230,550 | B2 | 7/2012 | Medema | |
| 8,756,757 | B2 | 6/2014 | Tran | |
| 9,186,028 | B2 | 11/2015 | Ashbaugh | |
| 9,295,365 | B2 | 3/2016 | Huffman | |
| 9,427,128 | B2 | 8/2016 | DeJonge | |
| 9,456,723 | B2 | 10/2016 | Thorne et al. | |
| 9,844,307 | B2 * | 12/2017 | Muir | A47L 9/0673 |
| 9,924,843 | B2 | 3/2018 | Song | |
| 9,968,235 | B2 | 5/2018 | Vail et al. | |
| 10,188,252 | B2 * | 1/2019 | Nguyen | A47L 11/4041 |
| 11,172,802 | B2 | 11/2021 | Bloomer et al. | |
| 11,241,134 | B2 | 2/2022 | Xia et al. | |
| 2003/0051309 | A1 * | 3/2003 | Morgan | A47L 5/34 15/373 |
| 2005/0091783 | A1 | 5/2005 | Sepke et al. | |
| 2006/0000051 | A1 | 1/2006 | Cipolla et al. | |
| 2008/0196193 | A1 | 8/2008 | Huffman et al. | |
| 2010/0306939 | A1 | 12/2010 | Dingert | |
| 2013/0318740 | A1 * | 12/2013 | DeJonge | A47L 11/4016 15/320 |
| 2017/0188768 | A1 | 7/2017 | Song | |
| 2020/0060498 | A1 | 2/2020 | Bradley et al. | |
| 2020/0205636 | A1 | 7/2020 | Johnson et al. | |
| 2021/0219806 | A1 | 7/2021 | Davila et al. | |

FOREIGN PATENT DOCUMENTS

| | | | |
|---|---|---|---|
| JP | 10295562 | A2 | 11/1998 |
| JP | 2002165707 | A2 | 6/2002 |
| WO | 08151743 | A2 | 12/2008 |

OTHER PUBLICATIONS

Intellectual Property Office Search Report under Patent Acts 1977 Section 17(5) by Rhodri Evans, South Wales, 3 pages, dated Jun. 12, 2018, issued in related GB Application No. GB1720893.5.

* cited by examiner

12

SURFACE CLEANING APPARATUS

CROSS-REFERENCE TO RELATED APPLICATION(S)

This application is a continuation of U.S. patent application Ser. No. 16/812,809, filed on Mar. 9, 2020, which is a continuation of U.S. patent application Ser. No. 15/841,666, filed on Dec. 14, 2017, which claims the benefit of U.S. Provisional Patent Application No. 62/435,120, filed on Dec. 16, 2016, all of which are incorporated herein by reference in their entirety.

BACKGROUND

Extraction cleaners are well-known surface cleaning apparatuses for deep cleaning carpets and other fabric surfaces, such as upholstery. Most carpet extractors comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other surface cleaning apparatuses include vacuum cleaners, which can have a nozzle adjacent the surface to be cleaned in fluid communication with a collection system and an agitator can be provided for agitating the cleaning fluid on the surface.

BRIEF DESCRIPTION

According to one aspect of the present disclosure, a surface cleaning apparatus for cleaning a surface includes a base assembly adapted for movement across a surface to be cleaned, an upright assembly pivotally connected to the base assembly, and a fluid recovery system having a suction source, a suction nozzle provided on the base assembly in fluid communication with the suction source, and a recovery container. The base assembly includes a base housing, a brush chamber including a rear wall defining a rear of the brush chamber, at least one brushroll in the brush chamber, and a brush housing releaseably attached to the base housing, the brush housing removable to access the at least one brushroll, wherein the rear wall is attached to and removable with the brush housing.

BRIEF DESCRIPTION OF THE DRAWINGS

The present disclosure will now be described with respect to the drawings in which.

DETAILED DESCRIPTION

Figure 1:
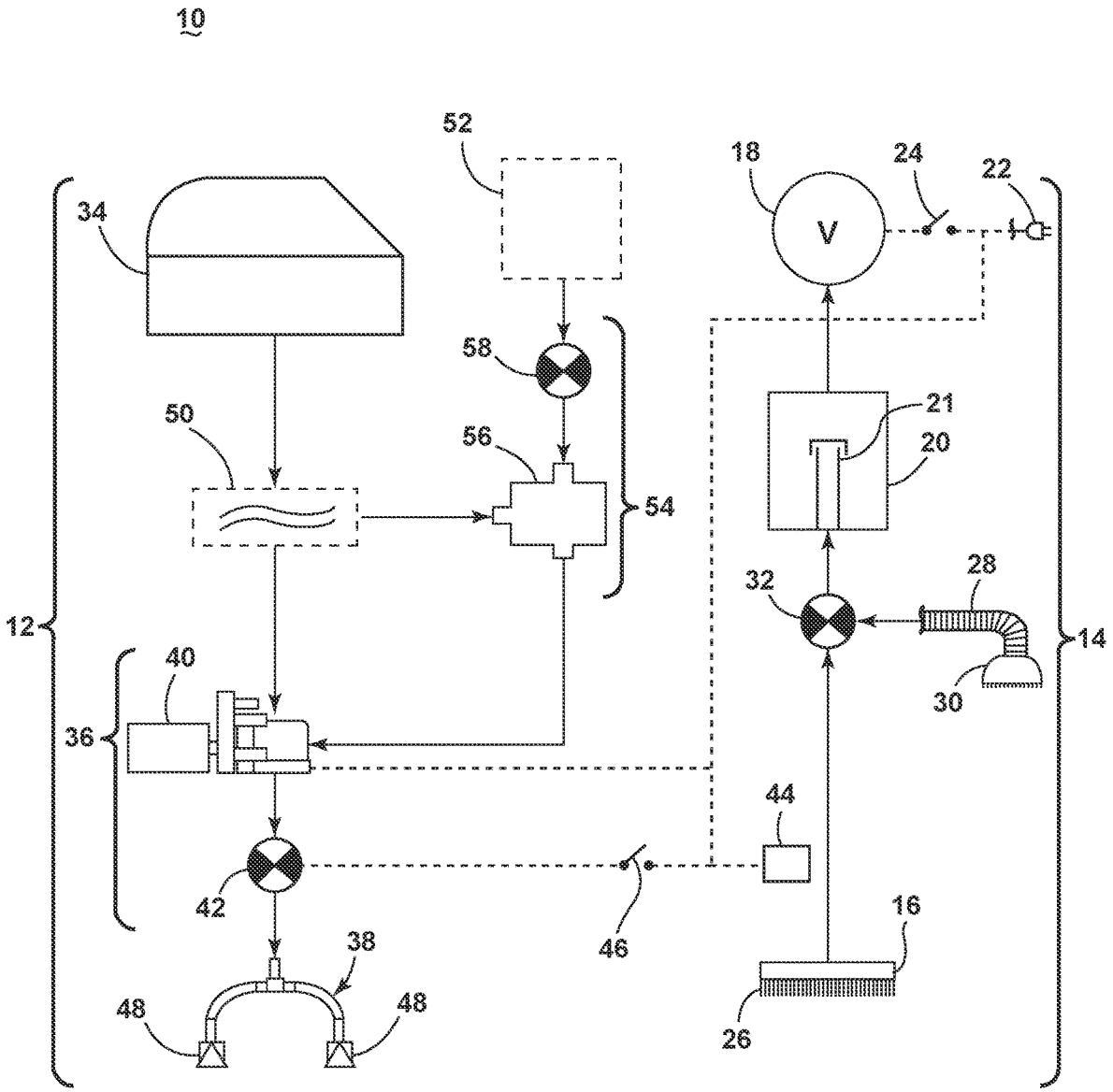
FIG. 1 is a schematic view of a surface cleaning apparatus in the form of an extraction cleaner.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, an autonomous or robotic extraction cleaner, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working airstream, and a recovery container 20 for separating and collecting fluid and debris from the working airstream for later disposal. A separator 21 can be formed in a portion of the recovery container 20 for separating fluid and entrained debris from the working airstream.

The suction source 18, such as a motor/fan assembly, is provided in fluid communication with the recovery container 20. The motor/fan assembly 18 can be electrically coupled to a power source 22, such as a battery or by a power cord plugged into a household electrical outlet. A suction power switch 24 between the motor/fan assembly 18 and the power source 22 can be selectively closed by the user, thereby activating the motor/fan assembly 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the motor/fan assembly 18 for above-the-floor cleaning using an above-the floor cleaning tool 30 with its own suction inlet. A diverter assembly 32 can be selectively switched between on-the-floor and above-the floor cleaning by diverting fluid communication between either the suction nozzle 16 or the vacuum hose 28 with the motor/fan assembly 18.

The fluid delivery system 12 can include at least one fluid supply container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the supply container 34 to at least one fluid distributor 38. In one configuration, the flow control system 36 can comprise a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In another example, the pump 40 can be a solenoid pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the distributor 38 can comprise multiple sprayers 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the supply container 34 and upstream of the pump 40. Other types of heaters 50 can also be used. In yet another example, the cleaning fluid can be heated using exhaust air from a motor-cooling pathway for the motor/fan assembly 18.

As another option, the fluid delivery system can be provided with an additional container 52 for storing a cleaning fluid. For example, the first supply container 34 can store water and the second container 52 can store a cleaning agent such as detergent. The containers 34, 52 can, for example, be defined by a supply tank and/or a collapsible bladder. In one configuration, the first supply container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the extraction cleaner 10 is prepared for use by coupling the extraction cleaner 10 to the power source 22, and by filling the first supply container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the motor/fan assembly 18 prior to being exhausted from the extraction cleaner 10. The recovery container 20 can be periodically emptied of collected fluid and debris.

Figure 2:
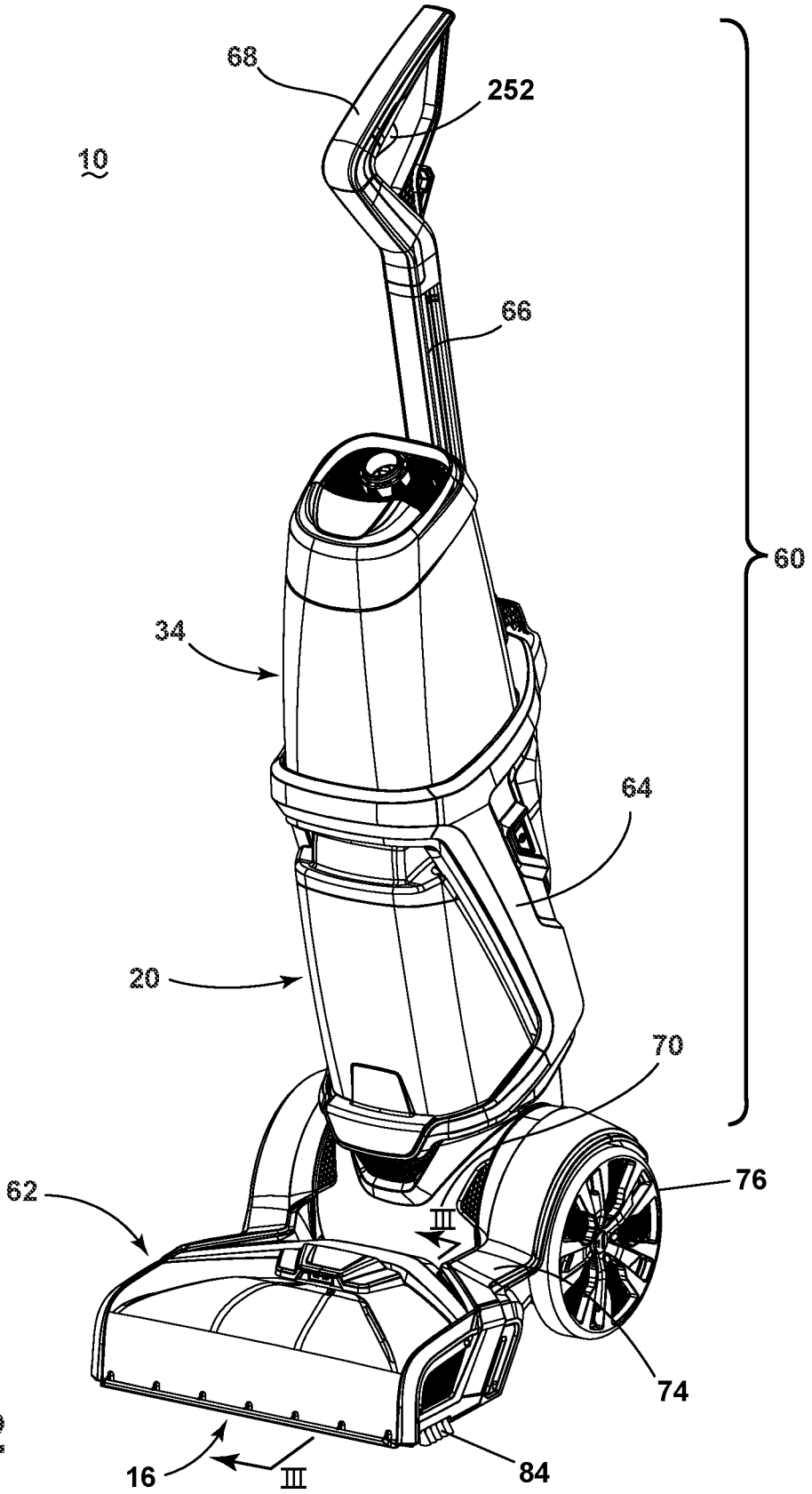
FIG. 2 is a front perspective view of an extraction cleaner according to one example of the present disclosure.

FIG. 2 is a perspective view illustrating one non-limiting example of an extraction cleaner 10, according to a first example of the present disclosure. As illustrated herein, the extraction cleaner 10 is an upright extraction cleaner having a housing that includes an upright assembly 60 that is pivotally connected to a base assembly 62 for directing the base assembly 62 across the surface to be cleaned. The extraction cleaner 10 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 62 and the upright assembly 60.

For purposes of description related to the figures, the terms "upper," "lower," "right," "left," "rear," "front," "vertical," "horizontal," "inner," "outer," and derivatives thereof shall relate to the present disclosure as oriented in FIG. 2 from the perspective of a user behind the extraction cleaner 10, which defines the rear of the extraction cleaner 10. However, it is to be understood that the present disclosure may assume various alternative orientations, except where expressly specified to the contrary.

The upright assembly 60 includes a main support section or frame 64 supporting components of the fluid delivery system 12 and the recovery system 14, including, but not limited to, the recovery container 20 and the fluid supply container 34. Additional details of the recovery container 20 for the extraction cleaner 10, which can include an air/liquid separator assembly (not shown) are disclosed in U.S. Pat. No. 10,188,252, issued Jan. 29, 2019, which is incorporated herein by reference in its entirety. The upright assembly 60 also has an elongated handle 66 extending upwardly from the frame 64 that is provided with a hand grip 68 at one end that can be used for maneuvering the extraction cleaner 10 over a surface to be cleaned. The frame 64 of the upright assembly 60 can include container receivers for respectively receiving the recovery and supply containers 20, 34 for support on the upright assembly 60; additional details of the container receivers are disclosed in U.S. Pat. No. 10,188,252, issued Jan. 29, 2019, and incorporated above. A motor housing 70 is formed at a lower end of the frame 64 and contains the motor/fan assembly 18 (FIG. 1) positioned therein in fluid communication with the recovery container 20. Additional details of the motor housing 70 are disclosed in U.S. Pat. No. 10,188,252, incorporated above.

The base assembly 62 includes a base housing 74 supporting components of the fluid delivery system 12 and the recovery system 14, including, but not limited to, the suction nozzle 16, the agitator 26, the pump 40, and at least one fluid distributor. Wheels 76 at least partially support the base housing 74 for movement over the surface to be cleaned. An additional agitator in the form of stationary edge brushes 84 may also be provided on the base assembly 62.

Figure 3:
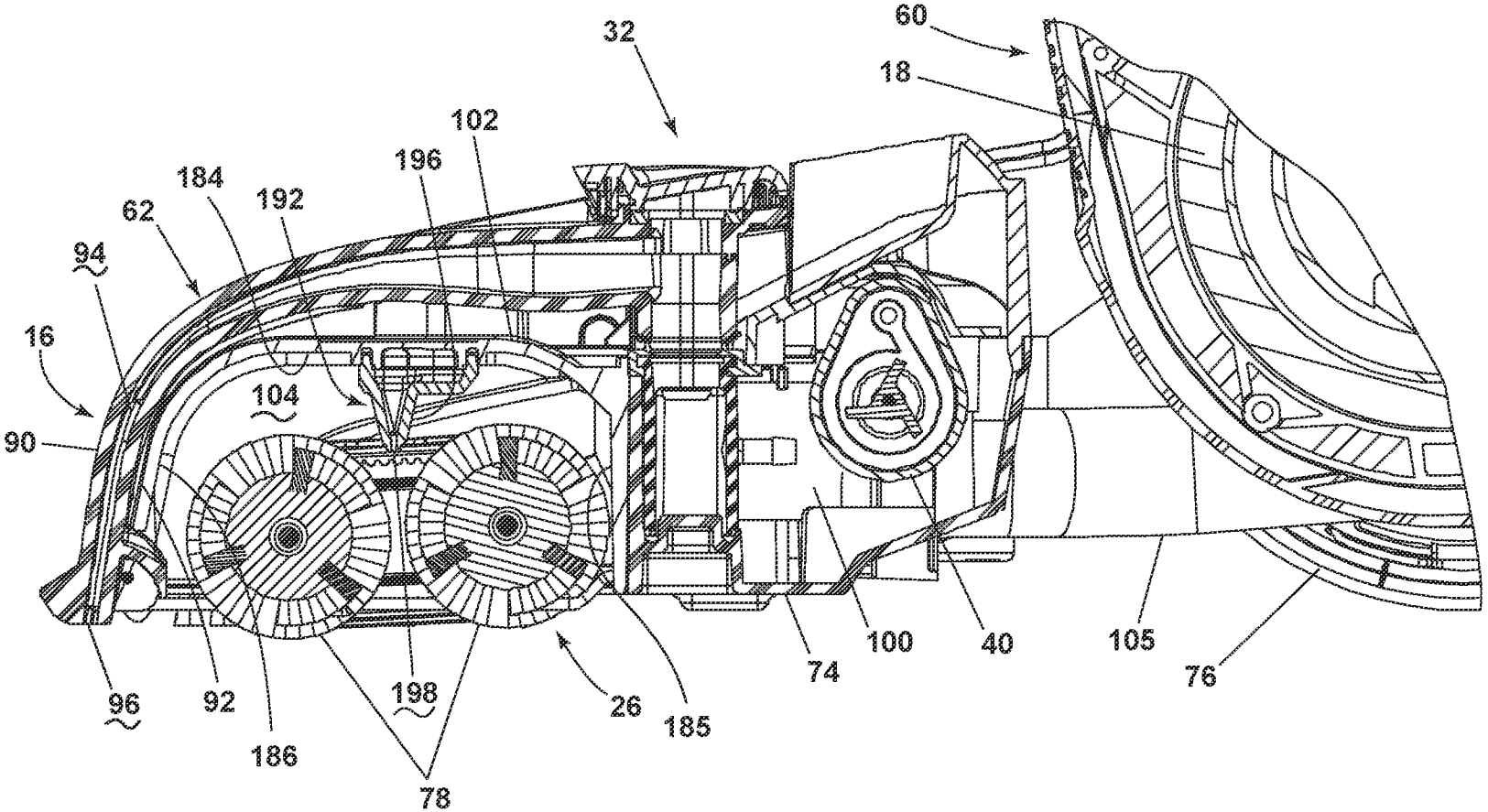
FIG. 3 is a cross-sectional view through a centerline of a base assembly of the extraction cleaner of FIG. 2.

FIG. 3 is a sectional view of the base assembly 62 of the extraction cleaner of FIG. 2. The suction nozzle 16 of the extraction cleaner 10 can include a front wall 90 and a rear wall 92 defining a narrow suction pathway 94 therebetween with an opening forming a suction nozzle inlet 96 adjacent the surface to be cleaned. The suction pathway 94 is in fluid communication with a recovery airflow conduit 100 leading to the recovery container 20 (FIG. 2). The suction nozzle 16 can be configured to be removable as a unit from the base assembly 62, with the front and rear walls 90, 92 fixedly attached together in a non-separable configuration. For example, the front and rear walls 90, 92 can be welded together.

An agitator housing or brush housing 102 is provided beneath the suction nozzle 16 and defines an agitator chamber or brush chamber 104 for the agitator 26, illustrated in the present example as a pair of brushrolls 78. The recovery airflow conduit 100 may be made up of one or more flexible and/or rigid sections, including a hose conduit 105 that passes from the base assembly 62 to the upright assembly 60. The hose conduit 105 can be flexible to facilitate pivoting movement of the upright assembly 60 relative to the base assembly 62. The brush housing 102 can be mounted to the base housing 74, which forms a rear portion of the base assembly 62 that also supports the suction nozzle 16.

The extraction cleaner 10 can be provided with a diverter assembly 32 for selectively switching between on-the-floor and above-the floor cleaning by diverting communication between either the suction nozzle 16 or the vacuum hose 28 with the motor/fan assembly 18. Details of the diverter assembly 32 and the vacuum hose 28 can be found in U.S. Pat. No. 10,188,252 incorporated above.

Figure 4:
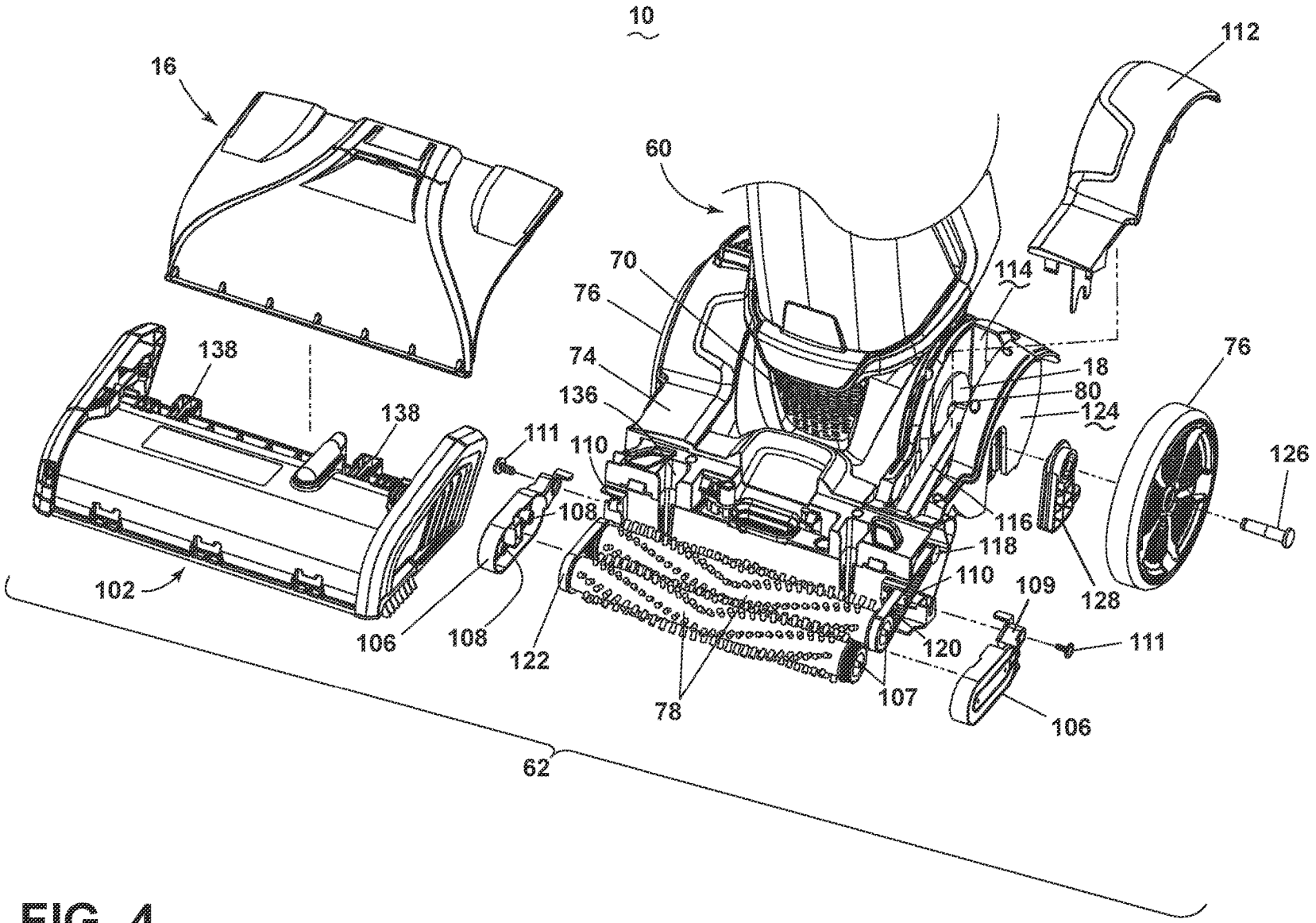
FIG. 4 is a partially exploded view of a lower portion of the extraction cleaner of FIG. 2, with a portion of the base assembly exploded to show a removable belt cover.

FIG. 4 is a partially exploded view of a lower portion of the extraction cleaner 10 of FIG. 2, with a portion of the base assembly 62 exploded to show a removable belt cover 112 of the extraction cleaner 10. The agitator 26 of the illustrated example includes dual horizontally-rotating brushrolls 78 which are operatively coupled with a drive shaft 80 of the motor/fan assembly 18 via a transmission, which can include one or more belts, gears, shafts, pulleys, or combinations thereof. In one example, the transmission includes at least one belt 116 coupled with the drive shaft 80 of the motor/fan assembly 18.

The brushrolls 78 can be supported by swing arms 106 which are pivotally mounted to the base housing 74. Each swing arm 106 engages one of the ends of the brushrolls 78 and the brushrolls 78 are held between the swing arms 106 for rotation about axes defined by elongated axles 107 on which the brushrolls 78 are mounted. The inner surface of the swing arms 106 include fittings 108 which hold the axles 107 in place; bearings (not shown) are provided between the axles 107 and the brushrolls 78 for rotation of the brushrolls 78 about the stationary axles 107.

The swing arms 106 have bearing sleeves 109 on one end that are received on cylindrical bearing surfaces 110 provided on the base housing 74, and about which the swing arms 106 rotate. The cylindrical bearing surfaces 110 can include a blind hole therein which receives a fastener 111 which attaches the swing arm 106 to the base housing 74. The brushrolls 78 can collectively pivot about an axis defined by the bearing sleeves 109 relative to the base housing 74 to adjust to the contour of the surface to be cleaned.

As more particularly shown herein, the transmission includes a first belt 116 coupled between the drive shaft 80 of the motor/fan assembly 18 and a jack shaft 118, a second belt 120 or timing belt coupled between the jack shaft 118 and the rear brushroll 78, and a third belt 122 coupled between the rear and front brushrolls 78. The third belt 122 can be coupled between the brushrolls 78 at an end of the brushrolls 78 opposite the second belt 120.

The pump 40 may also be operatively coupled with a drive shaft 80 of the motor/fan assembly 18 via the transmission, or via its own transmission. In the example shown herein, the pump 40 can be coupled with and driven by the jack shaft 118.

The belt cover 112 can enclose the first belt 116 with a belt chamber 114 that is defined within a portion of the base housing 74. The belt cover 112 can form a portion of the base housing 74 and a portion the belt cover 112 can extend over a wheel well 124 in which the one of the wheels 76 is mounted by an axle 126. The wheel well 124 can include a wheel retainer 128 over which the wheel 76 is mounted and which is engaged by the axle 126 to mount the wheel 76 in place.

Figure 5:
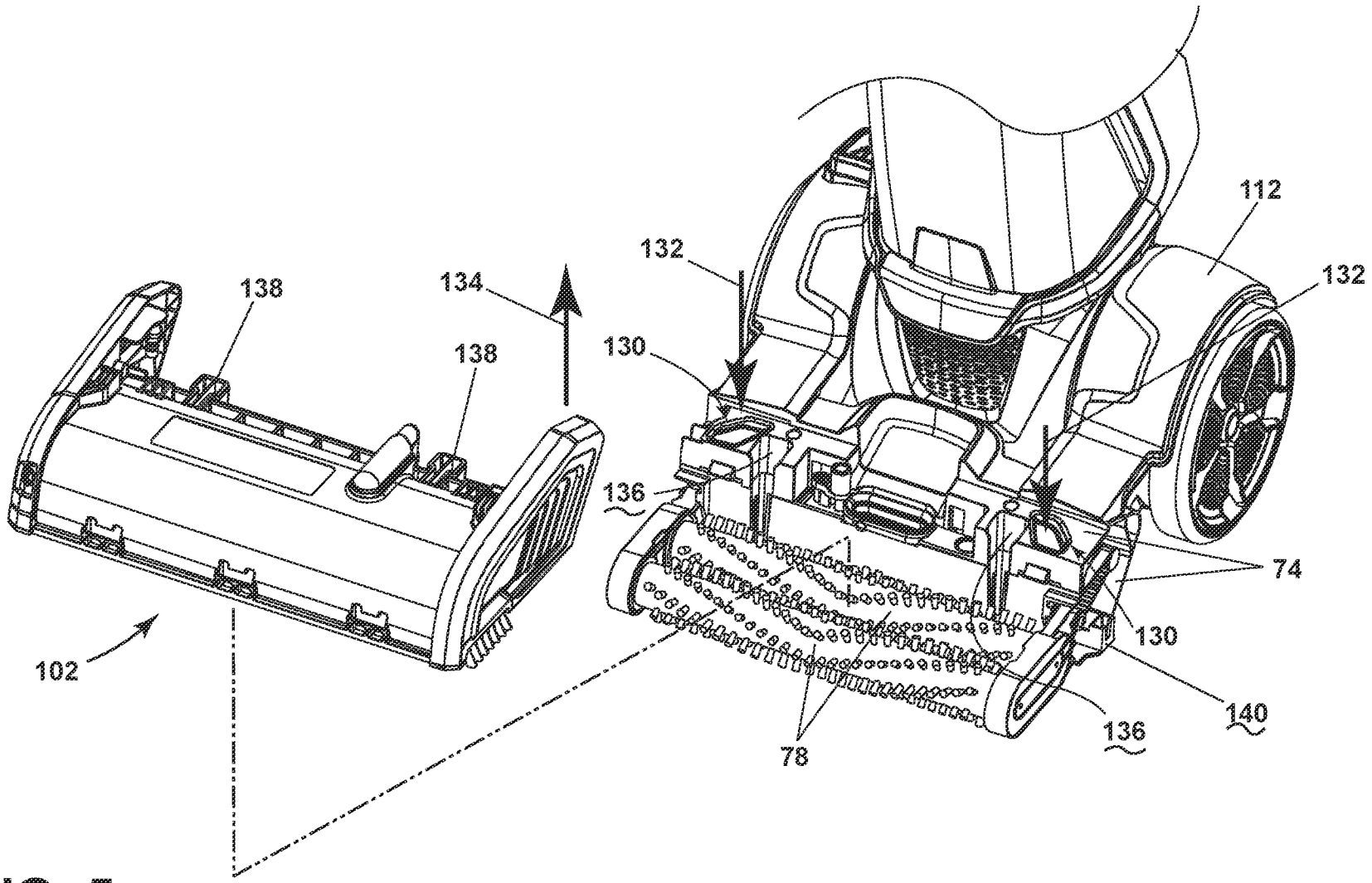
FIG. 5 is a partially exploded view of a lower portion of the extraction cleaner of FIG. 2, with a portion of the base assembly exploded to show a removable brush chamber.

FIG. 5 is a partially exploded view of a lower portion of the extraction cleaner 10 of FIG. 2, with a portion of the base assembly 62 exploded to show the removable brush housing 102 comprising the brush chamber 104. At least one lock assembly 130 is provided for selectively locking and unlocking the brush housing 102 to the base housing 74. As shown herein, two lock assemblies 130 are provided. The lock assemblies 130 can optionally comprise push button latches mounted to base housing 74 for quickly coupling or decoupling the brush housing 102 to the base housing 74. By pressing down on the push button latches 130, as indicated by arrows 132, a user can lift the brush housing 102 upwardly away from the base housing 74, as indicated by arrow 134.

It is noted that the brush housing 102 of the present example is removable from the base housing 74 after the suction nozzle 16 has already been removed. One exemplary process for removing the suction nozzle 16 is described in U.S. Pat. No. 10,188,252, incorporated above. It is noted however that other examples of the present disclosure can employ removable suctions nozzles that are removable according to a different process.

A self-aligning connection can be provided for guiding the assembly of the brush housing 102 with the base housing 74. The self-aligning connection as shown herein can include one or more receiving slots 136, such as T-shaped slots, on the base housing 74 which receive one or more corresponding protrusions 138, such as T-shaped protrusions, on the brush housing 102. As shown, two protrusions 138 can be provided on a rear of a brush casing 180 of the brush housing 102, and are received in corresponding slots 136 formed on the base housing 74 to the rear of the brushrolls 78 to form two separate connections. Optionally or alternatively, one or more receiving slots 140, such as T-shaped slots, can be provided on the sides of on the base housing 74 which receive one or more corresponding protrusions 142 (FIG. 12), such as T-shaped protrusions, on end caps 190 of the brush housing 102 to form two more separate connections.

These corresponding receiving slots 136, 140 and protrusions 138, 142 are configured to self-align the brush housing 102 on the base housing 74, including alignment of one or more fluid connections for supplying cleaning fluid to the brush housing 102, as described in further details below, and also provide a robust structural connection between the brush housing 102 and the base housing 74 with minimal gaps or play between the mating components when the brush housing 102 is assembled to the base housing 74. The receiving slots 136 can be tapered inwardly in both lateral and fore/aft directions with at the top of the slot 136 being larger than the bottom of the slots 136, such that the slots 136 provide a self-centering lead-in for the protrusions 138 which can also be tapered inwardly to correspond to the taper of the receiving slots 136.

Figure 6:
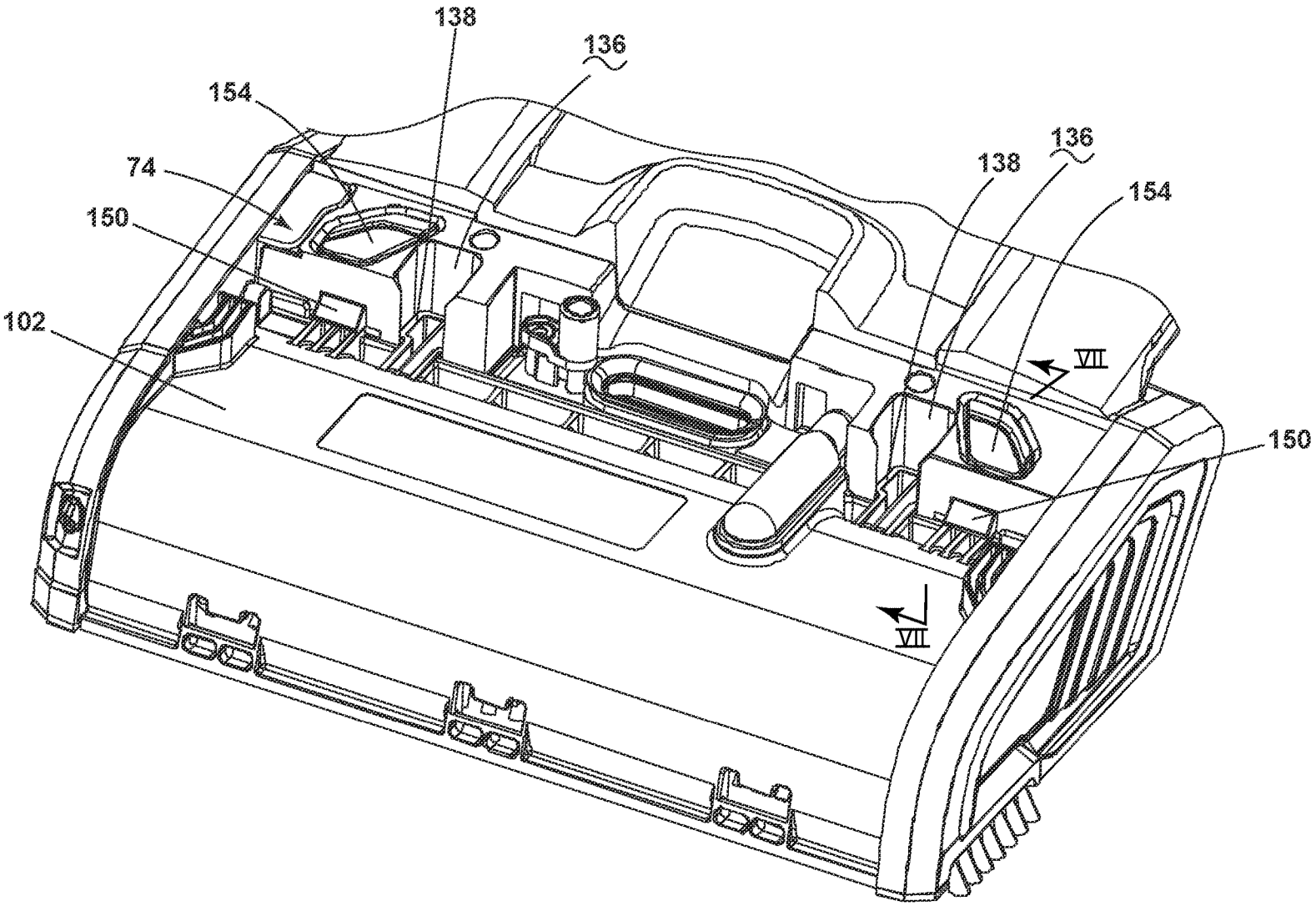
FIG. 6 is a close up view of a latch assembly for the removable brush chamber of FIG. 5.
Figure 7:
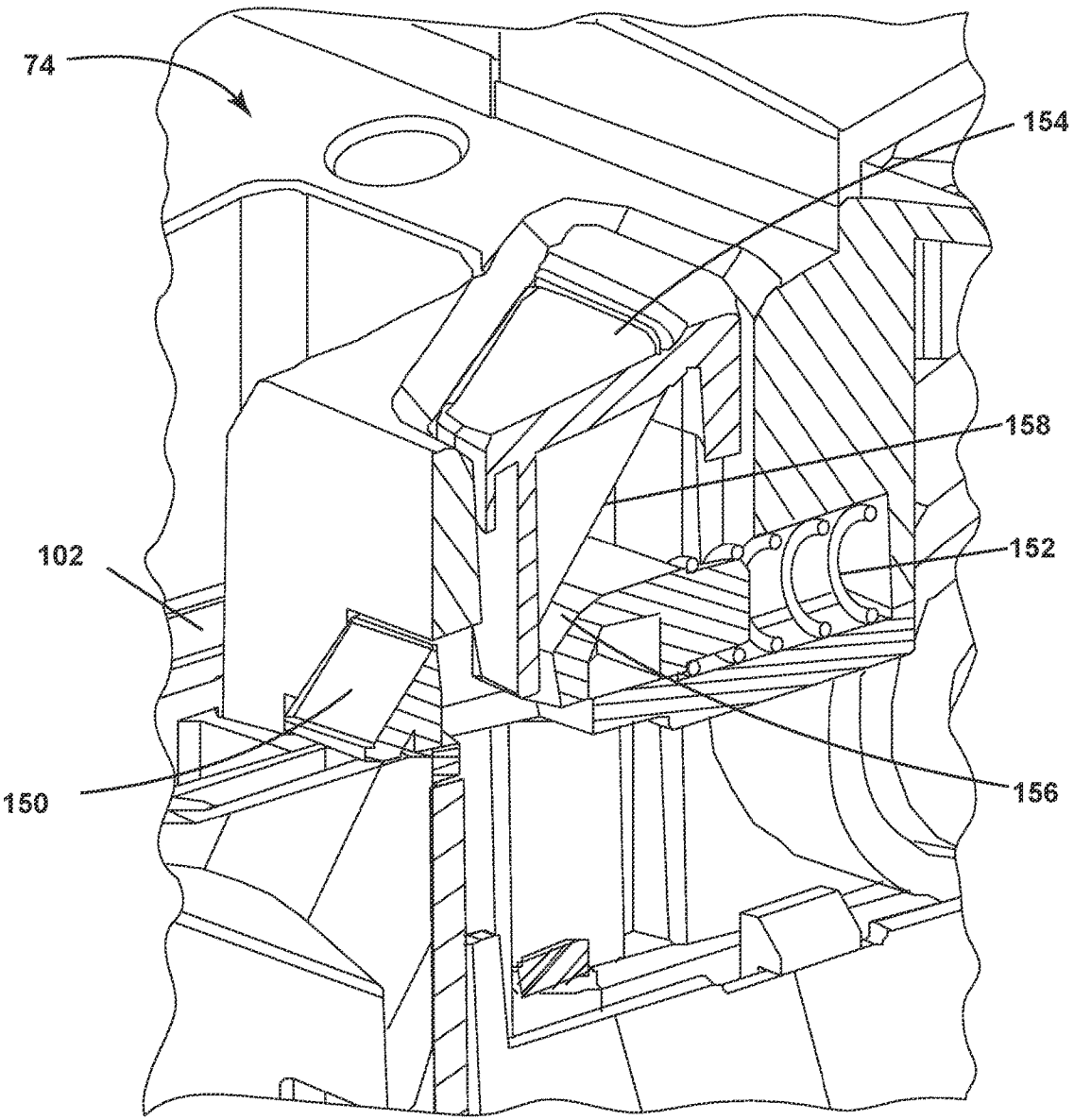
FIG. 7 is a sectional view through the latch assembly for the removable brush chamber of FIG. 5.

Referring to FIGS. 6-7, push button latches 130 include a latch 150 and a spring 152 which biases the latch 150 forwardly into a position where at least a portion of the latch 150 overlaps a portion of the brush housing 102. The push button latches 130 further include a button 154 which can be depressed to move the latch 150 rearwardly, out of engagement with the brush housing 102. As two push button latches 130 are provided, the buttons 154 are depressed simultaneously to release the brush housing 102.

The latch 150 includes a wedge-shaped cam surface 156 that is in operable engagement with a ramp 158 on the underside of the button 154. As the button 154 is pressed downward, the cam surface 156 is configured to ride along the ramp 158, which forces the latch 150 rearwardly, against the bias of the spring 152.

In use, a user depresses the buttons 154 on each side of the base housing 74 with their thumbs while simultaneously lifting upwardly on the brush housing 102 with their fingers to release the brush housing 102 from the base assembly 62, as shown in FIG. 5. While holding down on the buttons 154, the user lifts the brush housing 102 in a substantially vertical direction until the protrusions 138 clear the slots 136, and then the brush housing 102 can be carried away from the base housing 74. This configuration with the buttons 154 on the base housing 74, instead of on the brush housing 102, is easier to operate since the button actuating and brush housing lifting forces are applied to different components (i.e. the base housing 74 and the brush housing 102) whereas if the buttons 154 were on the brush housing 102, a user would need to push down while lifting the brush housing 102, which is an awkward maneuver to perform.

With reference to FIGS. 8-11, the belt cover 112 can be removed from the base assembly 62 in order to access the first belt 116 (FIG. 4). Accessing the belt 116 may be helpful during maintenance or when replacing the belt 116. The belt cover 112 can be attached to the base assembly 62 by a latch assembly 160 that can be unlatched or opened by the user using a tool 162.

An exemplary description of the operation to access the belt 116 follows. It will be appreciated by one of ordinary skill in the extractor art that the operation can proceed in any logical order and is not limited to the sequence presented below. The following description is for illustrative purposes only and is not intended to limit the scope of the present disclosure in any manner.

Figure 8:
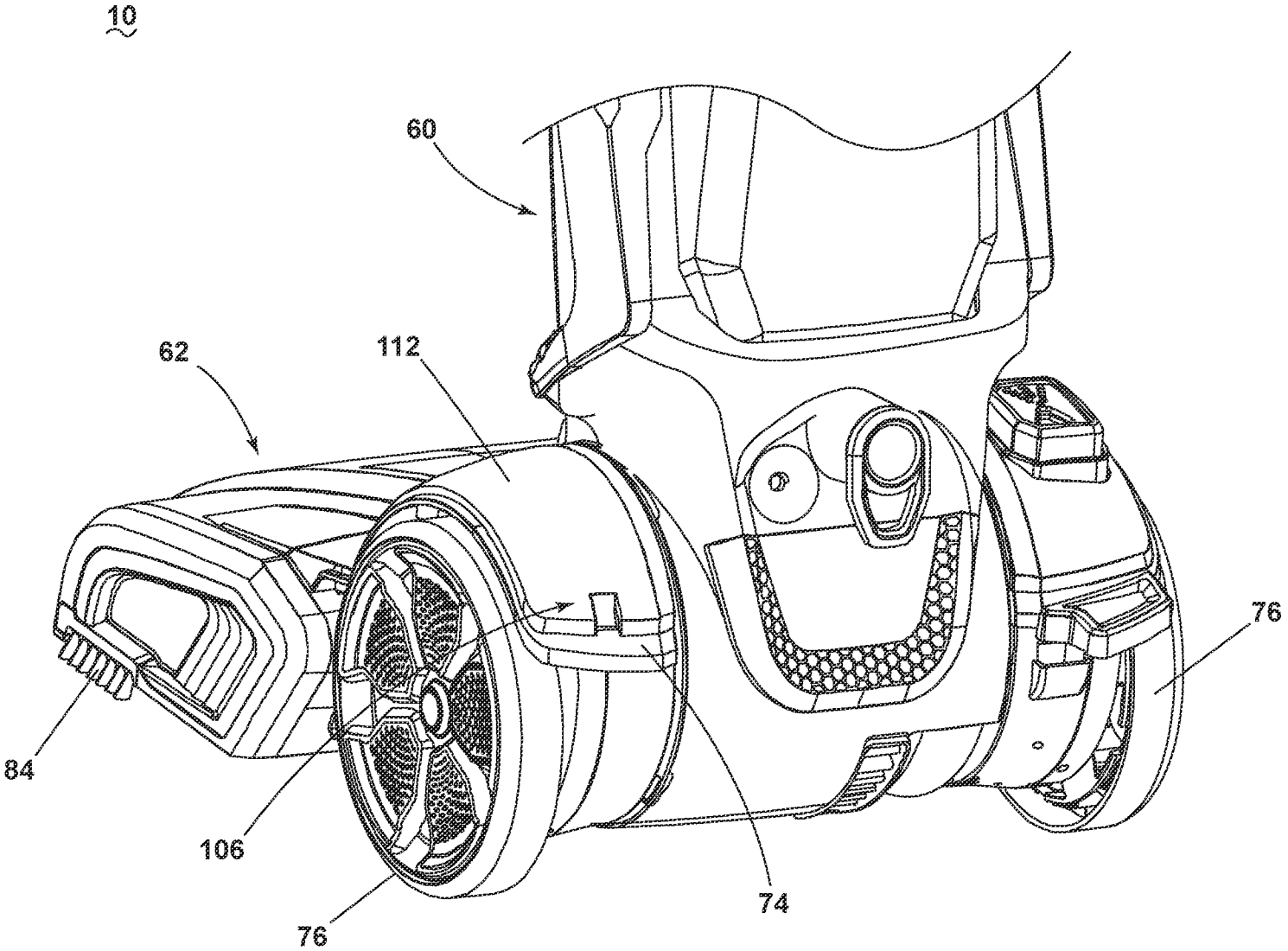
FIG. 8 is a rear perspective view of a lower portion of the extraction cleaner of FIG. 2.

To begin, the extraction cleaner 10 is in an upright or storage position as shown in FIGS. 1 and 8, i.e. where the upright assembly 60 is releasably retained in place by a detent or other handle locking mechanism, rather than a reclined or use position in which the upright assembly 60 is rotated to recline relative to the base assembly 62. The suction nozzle 16 and the brush housing 102 are removed from the base housing 72. Exemplary processes for removing the suction nozzle 16 and the brush housing 102 are described above.

Figure 9:
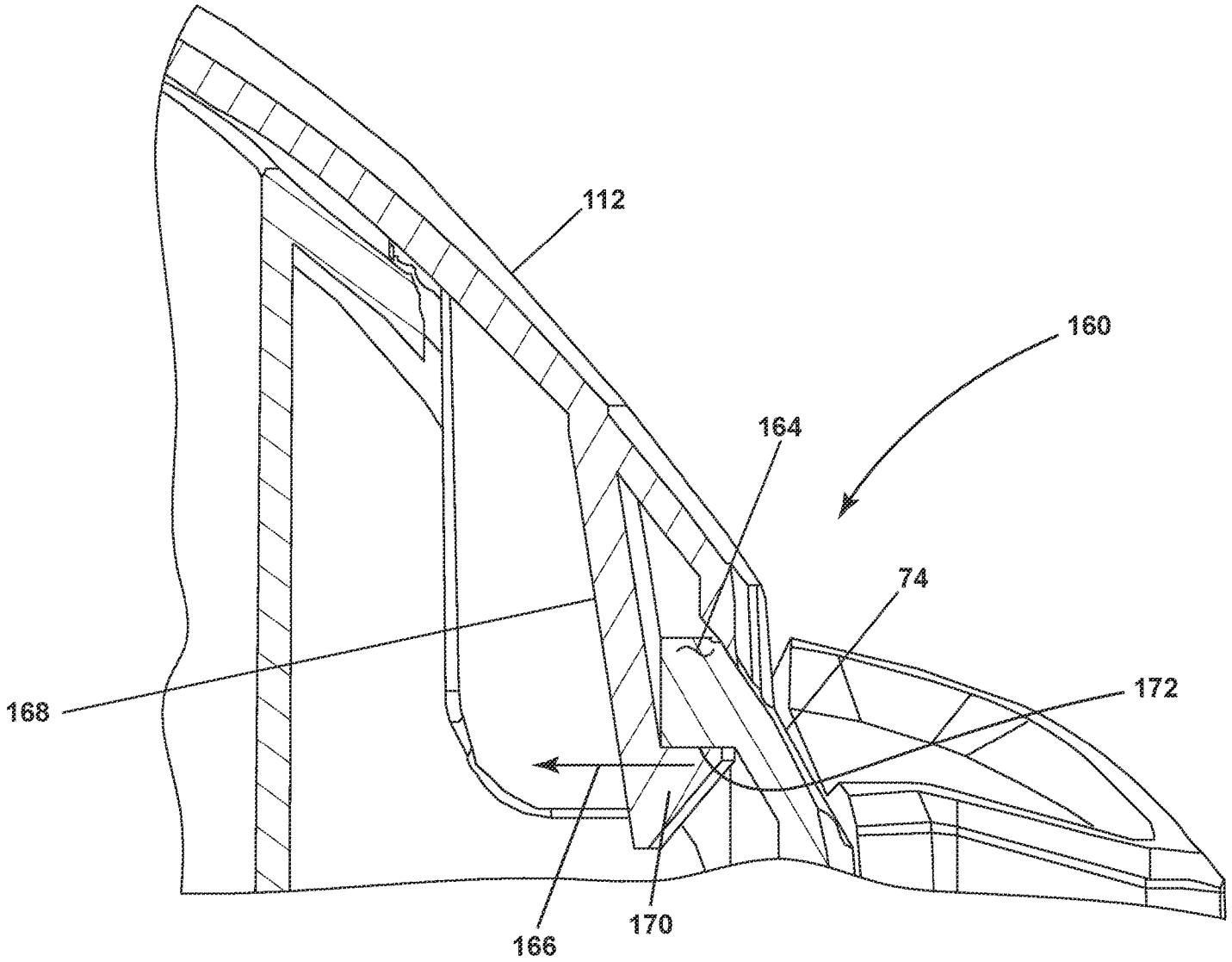
FIG. 9 is a sectional view through a latch assembly of the removable belt cover.
Figure 10:
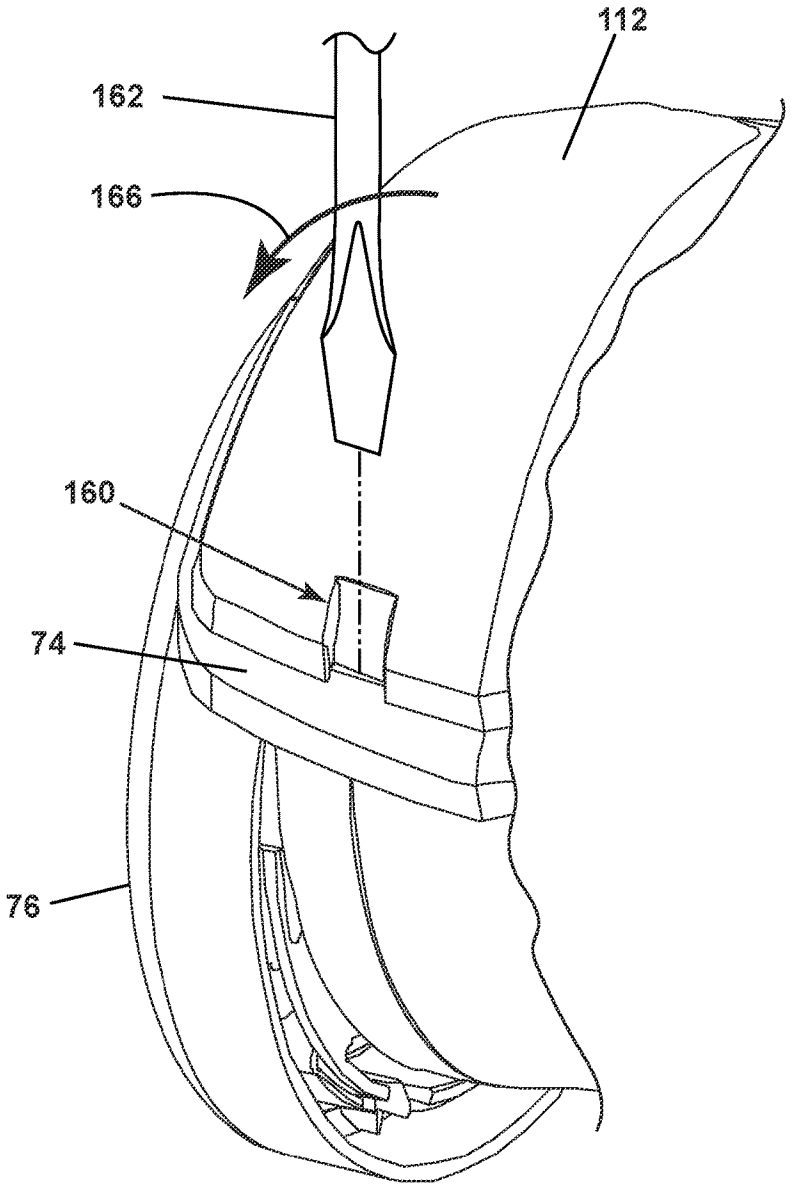
FIG. 10 is a rear view of the extraction cleaner showing the removal of the belt cover using a tool.

Next, with reference to FIGS. 9-10, the belt cover 112 then is removed from the base housing 74, which opens the belt chamber 114 (FIG. 4). This can be done with the upright assembly 60 reclined relative to the base assembly 62 all the way flat or until it can rest on the surface. As shown for the illustrated example, the belt cover 112 can be removed by inserting a tool 162, such as a flat head screwdriver, into a pocket 164 that is formed between the latch assembly 160 and the base housing 74 and prying in the direction indicated by arrow 166 in FIGS. 9-10. The latch assembly 160 includes a flexible latch 168 formed or otherwise coupled with the belt cover 112 and that has a latch head 170 at one end. The latch head 170 is adapted to be received underneath a latch retainer 172 formed on the base housing 74. Prying the tool 162 in the direction of arrow 166 flexes the latch 168 and moves the latch head 170 out of engagement with the latch retainer 172 to free the latch 168, allowing the belt cover 112 to be removed.

Figure 11:
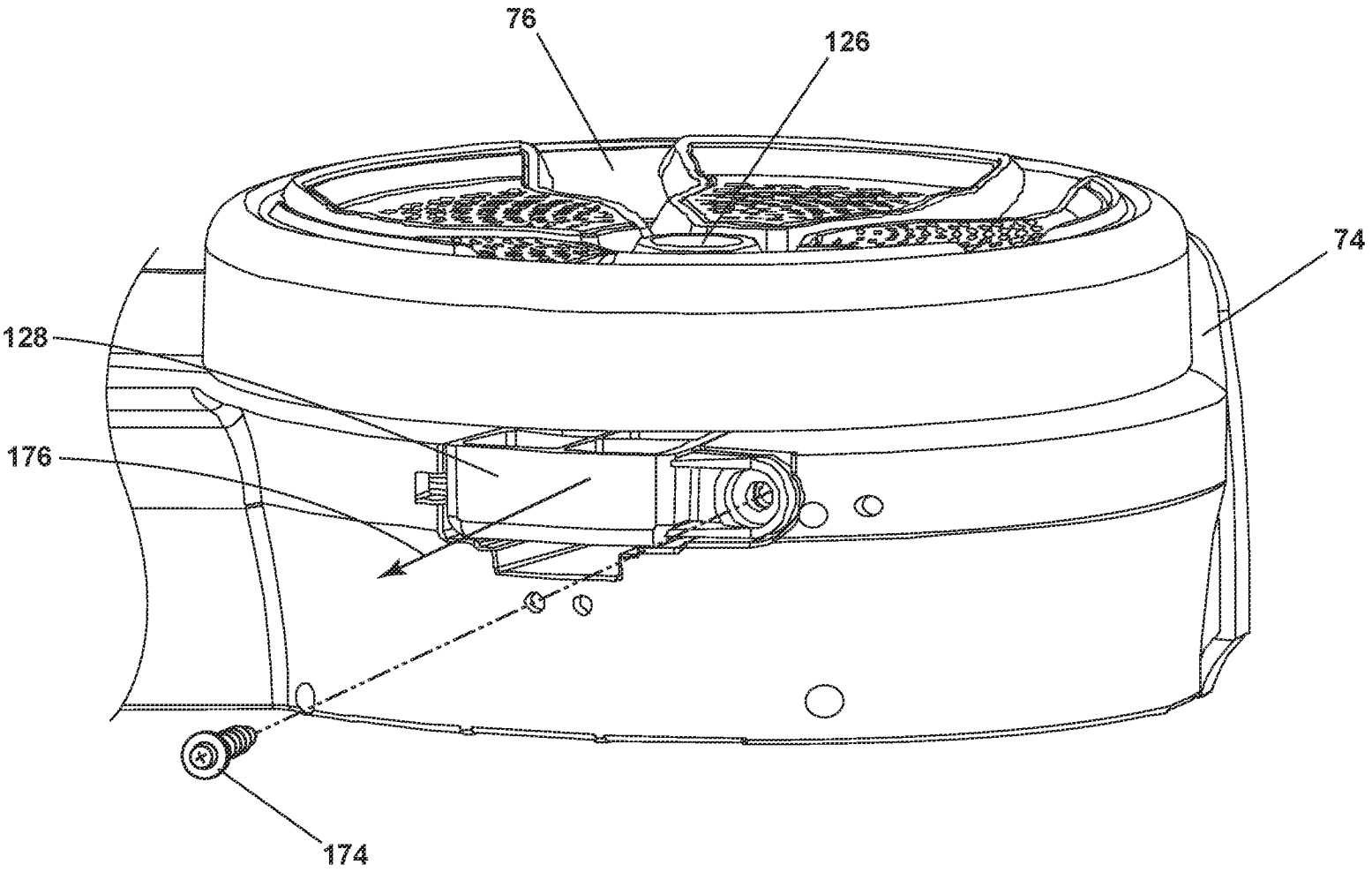
FIG. 11 is a view of the extraction cleaner showing the removal of a wheel of the extraction cleaner.

Then, the wheel 76 on the belt cover side of the base housing 74 can be removed from the base housing 74. This can be done with the extraction cleaner 10 turned on its side so that the wheel 76 is facing upward, as shown in FIG. 11. As shown for the illustrated example, the wheel 76 can be removed by removing a fastener or screw 174 from the wheel retainer 128, and then pulling the wheel 76, including the wheel axle 126 and retainer 128, outwardly in the direction indicated by arrow 176. The entire wheel assembly of the wheel 76, axle 126, and wheel retainer 128 is thereby removed from the base housing 74.

Referring to FIG. 4, next, the brush swing arms 106 can be removed, as well as the second belt 120. At this point, the user will have adequate access to the first belt 116 to service or replace it. It is noted that, for the illustrated example, removing the wheel 76 during this process is optional, as the first belt 116 can be accessed with the wheel 76 still installed on the base housing 74. However, removal of the wheel 76 helps improve the process by giving the user better access to the drive shaft 80 when replacing the first belt 116. Is also noted that while for the illustrated example both the suction nozzle 16 and the brush housing 102 must be removed in order to access the first belt 116, in other examples the first belt 116 may be accessible by only removing one or neither of these assemblies.

Referring to FIG. 5, the brush housing 102 can be formed as a removable modular unit and may include a brush casing 180 defining the brush chamber 104 for the rotatable brushrolls 78, at least one fluid distributor for the fluid delivery system, and associated conduits, connections, and/or fittings for coupling the at least one fluid distributor to the supply container 34. The brush casing 180 has a top wall 184 and a front wall 186 joined to a front edge of the top wall 184, and a pair of lateral sides 188. End caps 190 are mounted to the lateral sides 188 of the casing 180 and can form a portion of the sidewalls for the brush housing 102.

Figure 13:
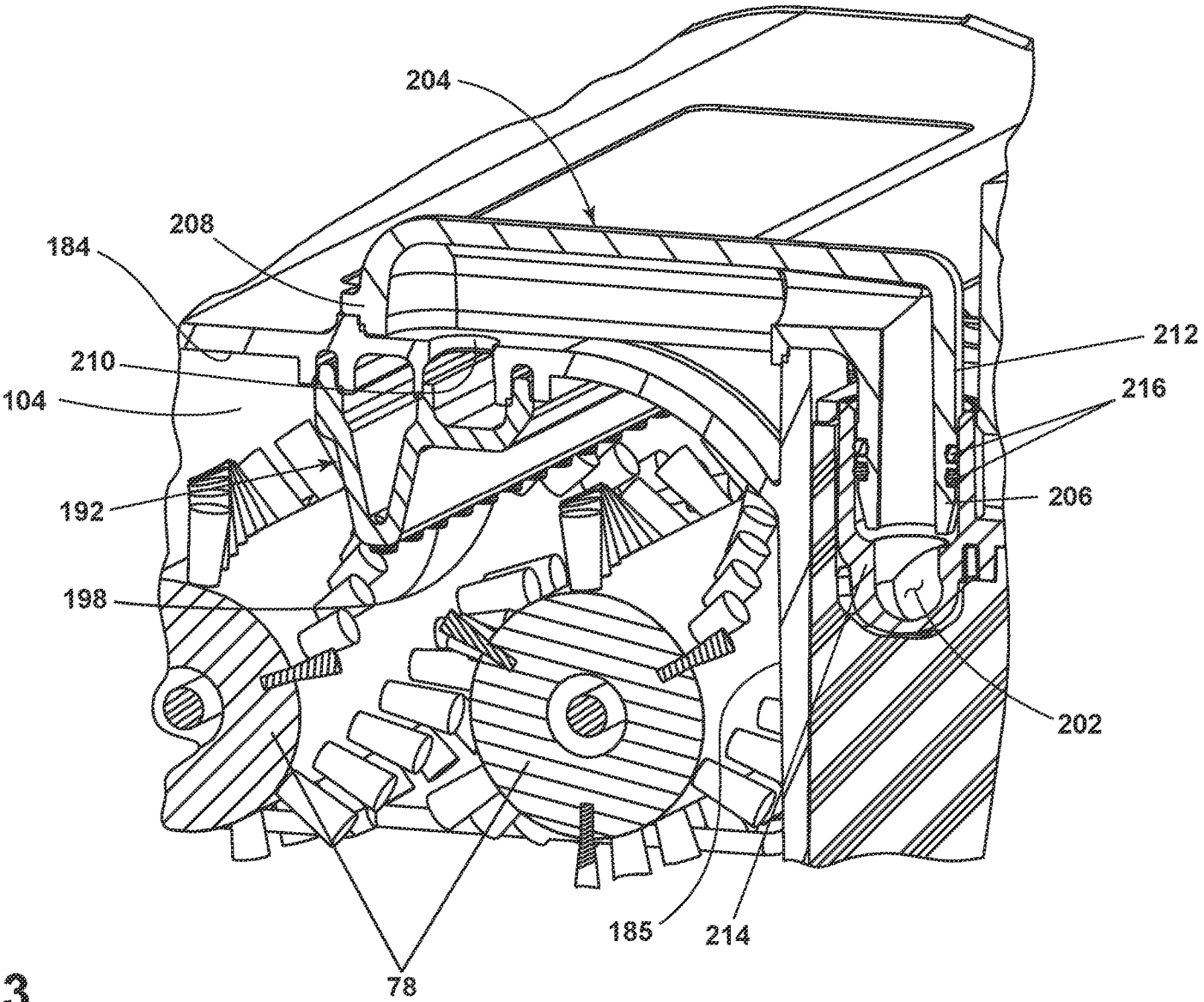
FIG. 13 is a sectional view through a fluid coupling for a primary fluid distributor of the extraction cleaner of FIG. 2.

Referring to FIG. 3, the brush housing 102 includes a rear wall 185 defining a rear of the brush chamber 104, and the rear wall 185 is attached to and removable with the brush housing 102. The rear wall 185 is also shown in FIG. 13. The rear wall 185 is joined to a rear edge of the top wall 184, which defines a top of the brush chamber 104, which is in turn joined to the front wall 186, which defines a front of the brush chamber 104. The rear and front walls 185, 186 generally depend downwardly from the top wall 184, behind and in front of, respectively, the brushrolls 78.

Figure 12:
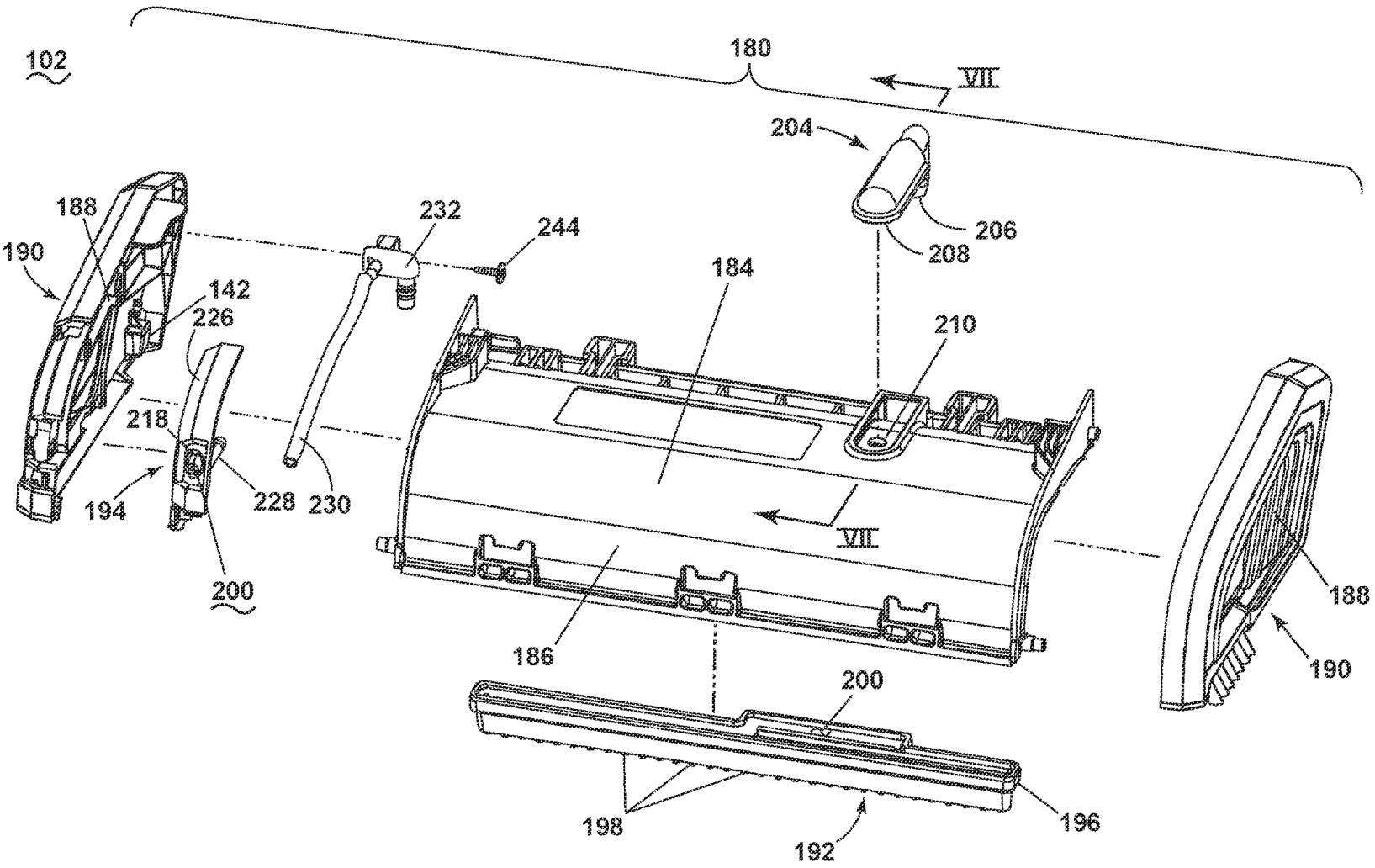
FIG. 12 is a partially exploded view of the brush chamber of FIG. 5.

FIG. 12 is a partially exploded view of the brush housing 102 of FIG. 5. The fluid delivery system of the illustrated example includes a primary fluid distributor 192 in fluid communication with the supply container 34 for depositing a cleaning fluid onto the surface, and an auxiliary fluid distributor 194 in fluid communication with the supply container 34 for depositing cleaning fluid onto a smaller section of the surface to be cleaned. The primary fluid distributor 192 and the auxiliary fluid distributor 194 may be mounted to the brush housing 102 as illustrated. Both distributors 192, 194 are removable together with the brush housing 102 as a removable modular unit. The inlets to the primary and auxiliary fluid distributors 192, 194 are fluidly connected and disconnected from the fluid source, i.e. the supply container 34, when the brush housing 102 is installed or uninstalled on the base housing 74, as described in more detail below.

The primary fluid distributor 192 includes at least one sprayer positioned to dispense fluid onto the surface to be cleaned. The at least one sprayer can dispense fluid directly onto the surface to be cleaned, such as by having an outlet of the sprayer positioned in opposition to the surface, or indirectly onto the surface to be cleaned, such as by having an outlet of the sprayer positioned to dispense toward the brushrolls 78.

The at least one sprayer of the primary fluid distributor 192 is illustrated as an elongated spray bar or manifold 196 provided with a plurality of distributor outlets 198 along its length. The spray manifold 196 is trough-like, with an open top 200 that receives fluid, which then flows along the length of the spray manifold 196 and out through the distributor outlets 198. The distributor outlets 198 can be position to dispense cleaning fluid between the brushrolls 78, shown in FIG. 3. As shown in FIG. 3, the spray manifold 196 can be mounted on the brush housing 102, and a portion of the brush casing 180 may form a portion of the conduit that supplies cleaning fluid from the supply container 34 to the spray manifold 196. Here the brush casing 180 may form an upper enclosure for a fluid pathway through the spray manifold 196 leading to the distributor outlets 198.

Figure 22:
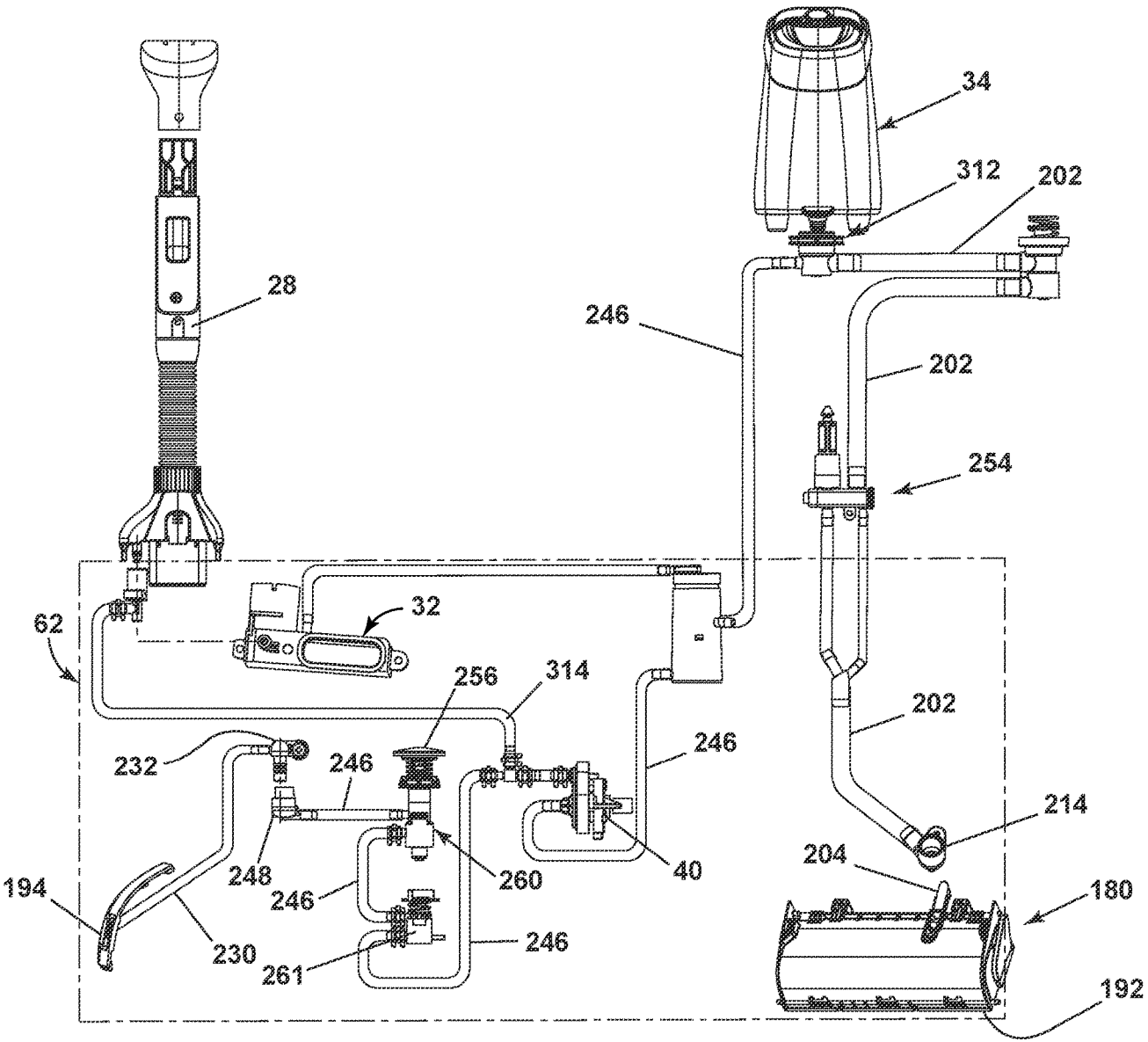
FIG. 22 is a schematic view of a fluid delivery system of the extraction cleaner of FIG. 2.

As shown in FIGS. 12 and 22, a conduit 202 supplies cleaning fluid from the supply container 34 to the spray manifold 196. The conduit 202 can extend from the base assembly 62 to the supply container 34 in the upright assembly 60, and may be made up of one or more flexible and/or rigid sections.

The primary fluid distributor 192 further includes an inlet barb 204 having an inlet end 206 in fluid communication with the conduit 202 and an outlet end 208 in fluid communication with the spray manifold 196. The inlet barb 204 is provided on top of the brush casing 180 of the brush housing 102, while the spray manifold 196 is provided on an underside of the brush casing 180. The outlet end 208 of the inlet barb 204 is aligned with a fluid port 210 in the brush casing 180 that passes fluid from the inlet barb 204 to the spray manifold 196.

With additional reference to FIG. 13, the inlet end 206 of the inlet barb 204 forms a first fluid coupler or connector 212 for the primary fluid distributor 192, while the conduit 202 comprises a second fluid coupler or receiver 214. When the brush housing 102 is mounted to the base housing 74, the first fluid coupler 212 automatically couples with the second fluid coupler 214 to place the primary fluid distributor 192 in fluid communication with the fluid delivery system. O-rings 216 are provided on the first fluid coupler 212 to seal the interface between the couplers 212, 214. When the brush housing 102 is removed from the base housing 74, the first fluid coupler 212 automatically decouples from the second fluid coupler 214 to break the fluid communication.

Figure 14:
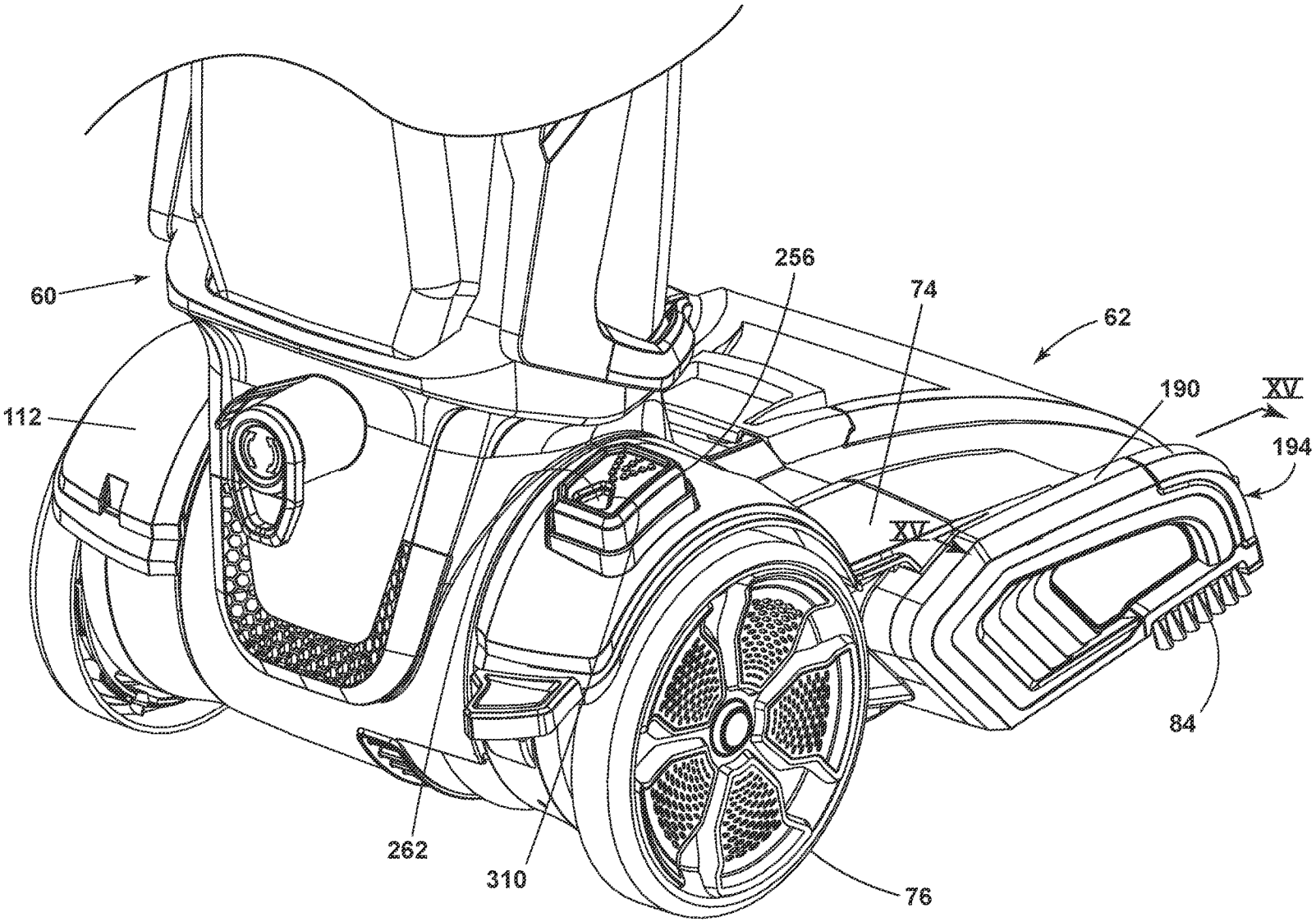
FIG. 14 is a rear perspective view of the base assembly of the extraction cleaner of FIG. 2 to show an auxiliary distributor and control pedal.

Referring to FIGS. 12 and 14, the auxiliary fluid distributor 194 includes at least one sprayer 218 positioned to dispense fluid onto a more limited or smaller area of the surface to be cleaned than the primary fluid distributor 192. The at least one sprayer 218 can dispense fluid directly onto the surface to be cleaned, such as by having an outlet 220 of the sprayer 218 positioned in opposition to the surface, or indirectly onto the surface to be cleaned, such as by having the outlet 220 of the sprayer 218 positioned to dispense onto the edge brushes 84, which are shown herein as positioned on the end caps 190 of the brush housing 102. As shown herein, the at least one sprayer 218 is positioned on the exterior of the brush housing 102 to spray forwardly of the suction nozzle 16, such that both the sprayer 218 and the fluid it dispenses is easily viewed by a user operating the extractor 10. This permits a user to see exactly where the spray from the auxiliary fluid distributor 194 strikes the surface to be cleaned, allowing for a more focused treatment of an area of the surface to be cleaned. This may be particularly useful when treating visible or hard-to-treat stains on the surface to be cleaned that are not sufficiently cleaned by the primary fluid distributor 192. As such, the primary fluid distributor 192 may be used during a normal cleaning operation to deliver cleaning fluid to the surface to be cleaned, while the auxiliary fluid distributor 194 may be used intermittently at a user's discretion to deliver a focused spray of cleaning fluid to a limited area of the surface of the cleaned separate and apart from the primary fluid distributor 192.

The at least one sprayer 218 of the auxiliary fluid distributor 194 is illustrated as a single sprayer mounted to one of the end caps 190 of the brush housing 102. The sprayer 218 can comprise a spray nozzle that dispenses fluid onto the surface to be cleaned and a sprayer cover 226 that at least partially covers the spray nozzle and a portion of the end cap 190. A spray conduit 228 extends rearwardly from the cover 226 and forms an inlet to the spray nozzle. The conduit 228 can engage with a flexible conduit or tubing 230 in fluid communication with a first fluid coupler or connector 232 for connecting the auxiliary fluid distributor 194 to the supply container 34 when the brush housing 102 is mounted to the base housing 74.

Figure 15:
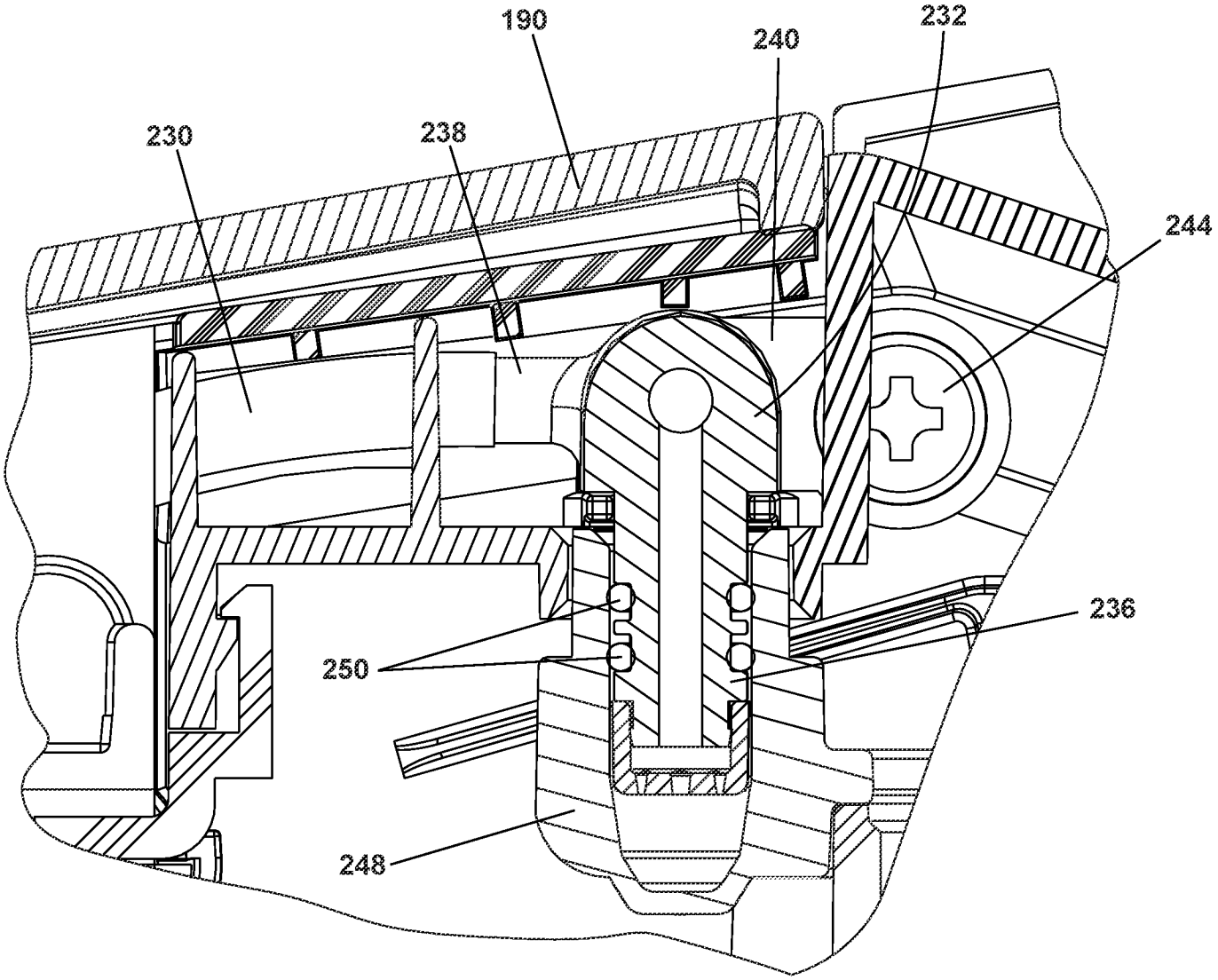
FIG. 15 is a sectional view through a fluid coupling for an auxiliary fluid distributor of the extraction cleaner of FIG. 2.

With additional reference to FIG. 15, the first fluid coupler 232 can comprise an L-shaped conduit having a single inlet 236 and outlet 238. One or both of the inlet 236 and outlet 238 can be defined by barbed sections of the L-shaped conduit. The coupler 232 further includes a mounting boss 240 connected to the L-shaped conduit which is used to connect the coupler 232 to the end cap 190 using a fastener 244. A screen (not shown) can cover the inlet 236 to prevent particulate above a certain size, as determined by the opening size of the screen, from entering the coupler 232.

A conduit 246 (FIG. 22) supplies cleaning fluid from the supply container 34 to the coupler 232. The conduit 246 can extend from the base assembly 62 to the supply container 34 in the upright assembly 60, and may be made up of one or more flexible and/or rigid sections. The pump 40 may form a portion of the conduit 246. The conduit 246 comprises a second fluid coupler or receiver 248 for the auxiliary fluid distributor 194 that is provided on the base housing 74 and is in communication with the supply container 34. When the brush housing 102 is mounted to the base housing 74, the first fluid coupler 232 automatically couples with the second fluid coupler 248 to place the auxiliary fluid distributor 194 in fluid communication with the fluid delivery system. O-rings 250 are provided on the first fluid coupler 232 to seal the interface between the couplers 232, 248. When the brush housing 102 is removed from the base housing 74, the first fluid coupler 232 automatically decouples from the second fluid coupler 248 to break the fluid communication.

The extraction cleaner 10 can be provided with separate actuators for the primary and auxiliary fluid distributors 192, 194, such that the flow of cleaning fluid from the primary and auxiliary fluid distributors 192, 194 can be independently and individually activated and controlled. The flow control actuator for the primary fluid distributor 192 is configured to control the flow of cleaning fluid from the supply container 34 to the primary fluid distributor 192, and the flow control actuator for the auxiliary fluid distributor 194 is configured to control the flow of cleaning fluid from the supply container 34 to the auxiliary fluid distributor 194.

In the illustrated example, the flow control actuator for the primary fluid distributor 192 comprises a trigger 252 (FIG. 2) provided within the hand grip 68 and operably coupled with a flow controller assembly 254 (FIG. 22) of the fluid delivery system to dispense fluid from the primary fluid distributor 192. The trigger 252 can be positioned inside of the hand grip 68 for easy manipulation by a trigger finger of the user's hand that is gripping the hand grip 68.

FIG. 14 is a rear perspective view of the base assembly 62 of the extraction cleaner 10 of FIG. 2 to show a flow control actuator for the auxiliary fluid distributor 194 in the form of a control pedal 256 for a push-push flow control mechanism. The control pedal 256 can be provided on the base assembly 62 and is operably coupled with the push-push flow control mechanism to dispense fluid from the auxiliary fluid distributor 194.

The pedal 256 is configured and adapted to be actuated by the foot of a user of the extraction cleaner 10. The pedal 256 can be provided on a rear, upper portion of the base assembly 62, such as on a rear, upper portion of the base housing 74 next to or rearwardly of the upright assembly 60, such that it can be easily pressed by the foot of the user operating the extraction cleaner 10 from the normal operational position behind the extraction cleaner 10. As shown herein, the pedal 256 can be provided on an opposing side of the base assembly 62 as the removable belt cover 112.

Figure 16:
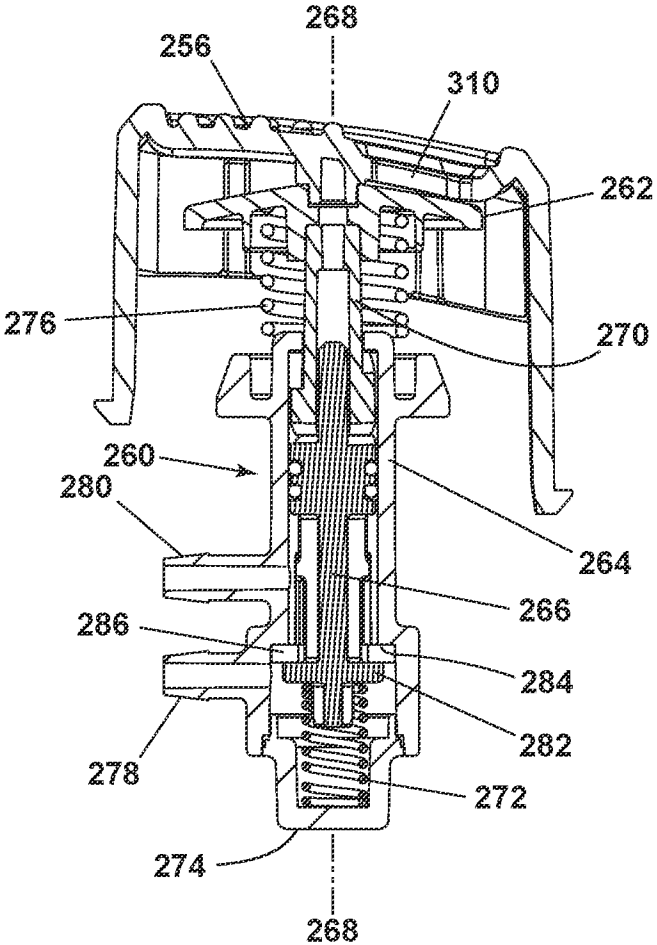
FIG. 16 is a sectional view through a push-push flow control valve for the auxiliary fluid distributor from FIG. 14, where the valve is shown in a closed position.

FIG. 16 is a sectional view through the push-push flow control mechanism for the auxiliary fluid distributor 194. The push-push flow control mechanism can include a mechanically-actuated valve 260. The push-push flow control mechanism has a "push on/push off" configuration, where pushing the control pedal 256 once starts fluid flow by opening the valve 260 and subsequently pushing the control pedal 256 again stops fluid flow by closing the valve 260. A status indicator 262 can be provided on the control pedal 256 to indicate to the user whether fluid is spraying from the auxiliary fluid distributor 194 or not. In one example, the status indicator 262 can indicate to the user when fluid is spraying from the auxiliary fluid distributor 194. It is noted that the push-push flow control mechanism can be replaced by a momentary flow control mechanism, such as a spring biased momentary valve, for example. In this instance, pushing the control pedal 256 would start fluid flow by opening the valve 260, but releasing the control pedal 256 would immediately stop fluid flow by closing the valve 260. This is unlike the push-push flow control mechanism, which continues fluid flow after the control pedal is initially depressed until the control pedal 256 is depressed a second time to stop fluid flow.

The valve 260 is coupled with the pedal 256 and includes a valve body 264 that remains fixed in its location, a valve piston 266 that moves up and down the central axis 268 of the valve 260, a plunger 270 that moves up and down and rotates relative to the central axis 268. The pedal 256 acts as an interface between the user and the valve 260. A first spring 272 can bias the valve piston 266 upwardly away from a bottom or end wall 274 of the valve body 264, and a second spring 276 biases the pedal 256 upwardly away from the valve body 264.

Figure 17:
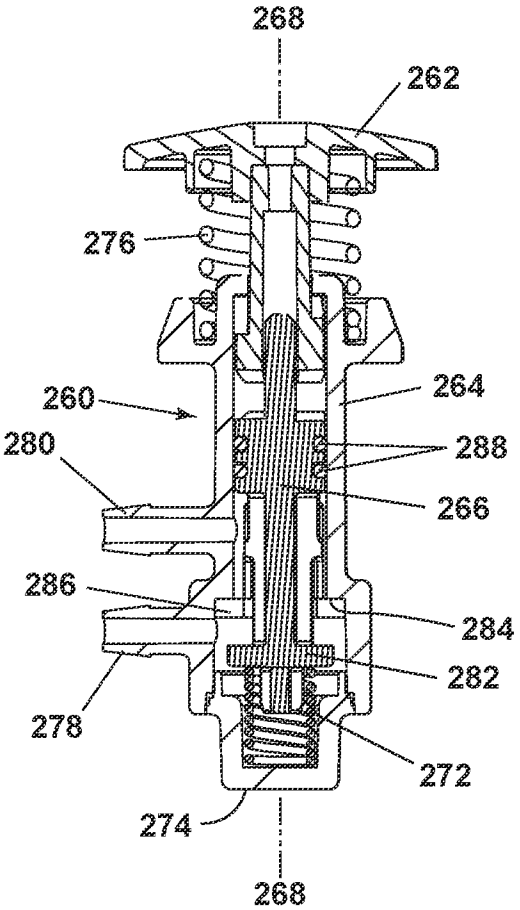
FIG. 17 is a sectional view similar to FIG. 16, where the valve is shown in an open position.

The valve body 264 includes an inlet 278 in fluid communication with the pump 40 (see FIG. 22) and an outlet 280 in fluid communication with the auxiliary fluid distributor 194. A passageway or fluid pathway through the valve body 264 connects the inlet 278 and outlet 280. The outlet 280 is blocked by the valve piston 266 when the valve 260 is closed or the control pedal 256 is in the "off" position, as shown in FIG. 16, and the valve piston 266 moves to unblock the outlet 280 when the valve 260 is open or the control pedal 256 is in the "on" position, as shown in FIG. 17. More particularly, the valve piston 266 includes a flange 282 and the valve body 264 includes a valve seat 284 and a valve seal 286. The flange 282 contacts the face of the seal 286 when the valve 260 is closed, as shown in FIG. 16. When open, as shown in FIG. 17, the flange 282 moves away from the valve seal 286, to a position at least partially below the inlet 278, such that the fluid pathway through the valve body 264 is open between the inlet 278 and outlet 280. The valve seal 286 can be a resilient washer mounted on the valve seat 284. O-rings 288 can be provided on the valve piston 266 to ensure that fluid does not leak past the valve piston 266 through an upper portion of the valve body 264.

Figure 18:
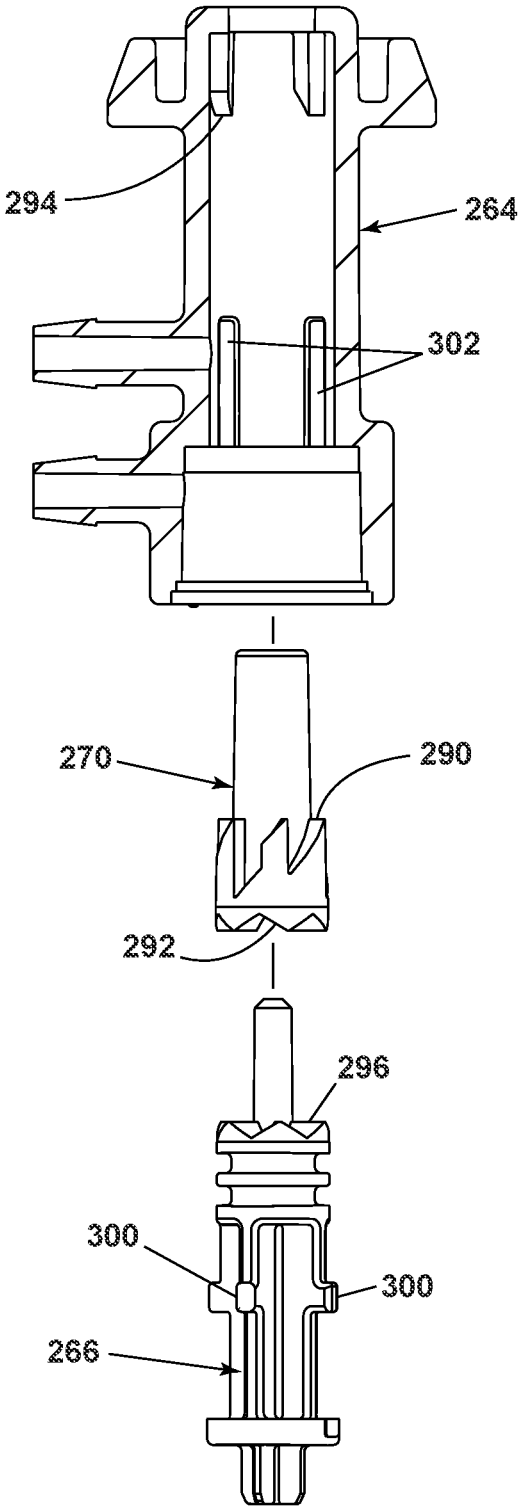
FIG. 18 is a partially exploded and partial sectional view through the valve of FIG. 16.

Referring to FIG. 18, a mechanical linkage couples the valve 260 with the pedal 256 for opening and closing the valve 260. As shown herein, the mechanical linkage can comprise a cam assembly. In general, the cam assembly can include at least one cam and cam follower. A cam of the example shown herein is the plunger 270, which is coupled to the pedal 256 to move up and down with the pedal 256, as well as to rotate about the central axis 268 from the engagement of cam surface. A cam follower of the example shown herein is the valve piston 266, which move up and down central axis 268 from the engagement of cam surfaces. The function of the valve 260 shown herein further relies on cam interfaces between the plunger 270 and the valve body 264.

The cam interfaces include an upper cam surface 290 and a lower cam surface 292 on the plunger 270, a cam surface 294 on the valve body 264 that corresponds to the upper cam surface 290 on the plunger 270, and a cam surface 296 on the valve piston 266 that corresponds to the lower cam surface 292 on the plunger 270. The cam interfaces are configured to rotate the plunger 270 during both a downward stroke and upward return stroke. A cam guide can be provided for guiding the movement of the valve piston 266 in a controlled manner; as shown, the cam guide can include one or more radial projections 300 from the valve piston 266 which is/are received in one or more corresponding elongated slots 302 in the interior of the valve body 264. The cam surfaces can include various cam profiles on the plunger 270, valve body 264, and valve piston 266.

Figure 19:
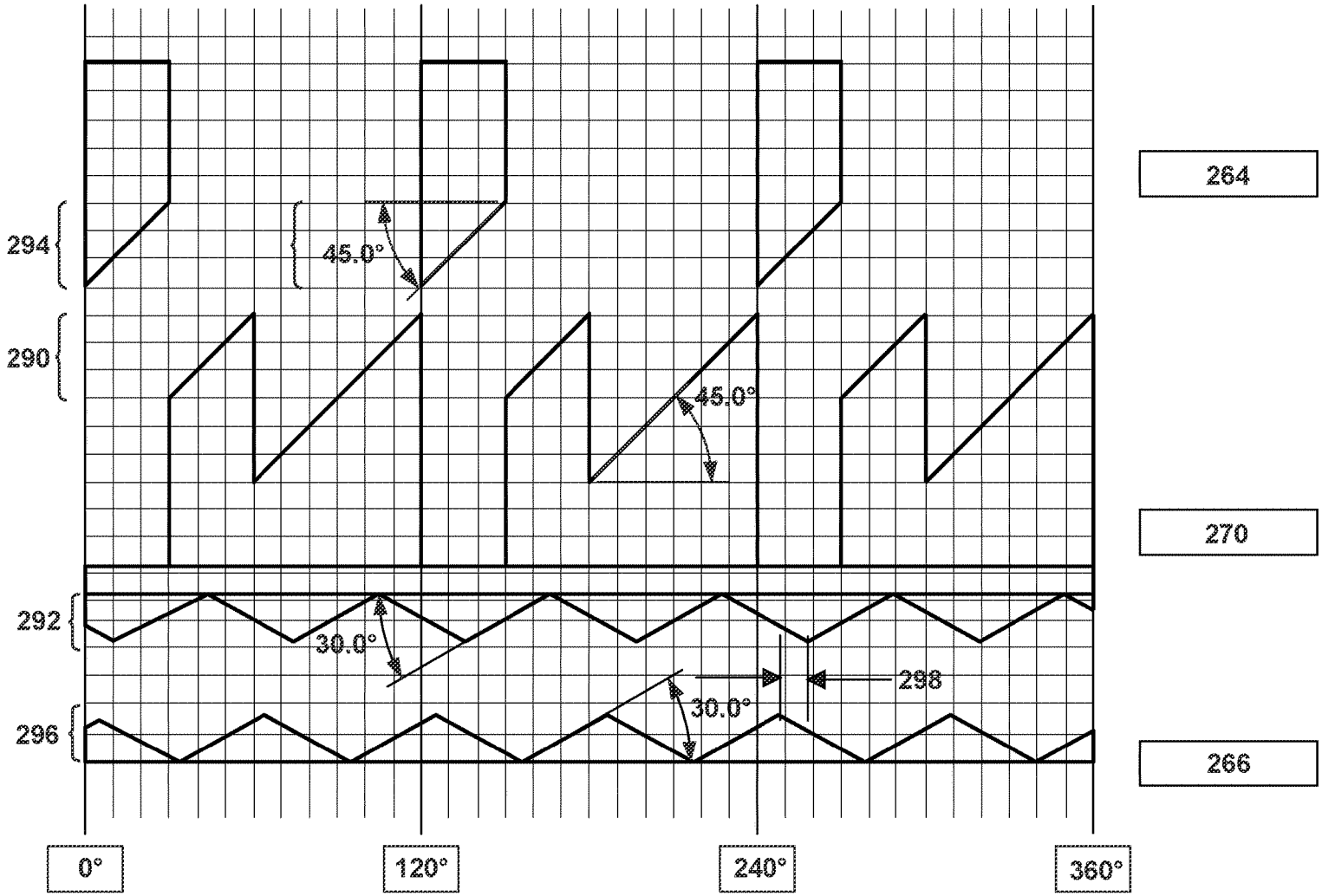
FIG. 19 is a schematic view the cam profiles for the valve of FIG. 16.

One example of the cam profiles is shown in FIG. 19 and illustrates how the cam interfaces are configured to rotate or index the plunger 270 a total of 60 degrees per cycle, each cycle comprising a downward and upward stroke of the plunger 270. For FIG. 19, a scale of 10 degrees per grid box is used. The lower cam surface 292 of the plunger 270 is offset, as indicated by reference numeral 298, from the cam surface 296 on the valve piston 266 by 10 degrees and the remaining cam interfaces are configured such that on a downward stroke, the plunger 270 will rotate 20 degrees whereas on an upward stroke, the plunger 270 will rotate 40 degrees.

In operation, when the user presses downward on the pedal 256, the lower cam surface 292 on the plunger 270 will engage the cam surface 296 of the valve piston 266. As the downward motion continues, the upper cam surface 290 on the plunger 270 will clear the fixed cam surface 294 on the valve body 264. The interface between the plunger 270 and valve piston 266 will cause the plunger 270 to rotate. In the illustrated example the plunger 270 rotates 20 degrees in a counterclockwise direction on the downward plunger 270 stroke. When the pedal 256 is released, the spring force will cause the plunger 270 and valve piston 266 to move upward, however, the plunger 270 will be fixed in a lower position due to the interface between the upper cam surface 290 of the plunger 270 and the valve body 264. The valve piston 266 will not be able to return to its "seated" position, causing the valve 260 to stay open, as shown in FIG. 17. In the illustrated example, the plunger 270 rotates 40 degrees in a counterclockwise direction on the upward plunger 270 stroke. When the user presses the pedal 256 again, the same interaction between all the cam surfaces will repeat causing the plunger 270 to rotate another 20 degrees. When the pedal 256 is released, the interface between the upper cam surface 290 of the plunger 270 and the valve body 264 will rotate the plunger 270 another 40 degrees, allowing the valve piston 266 to return to its "seated" position and the valve 260 will close, as shown in FIG. 16.

When the valve 260 is open, a continuous spray of fluid will be provided by the auxiliary fluid distributor 194, until the pedal 256 is pushed again. A mechanism can be provided for automatically turning off the spray from the auxiliary fluid distributor 194 in case the pedal 256 is accidentally pressed or it is left in the "on" position. For example, a detent-activated spring valve 261 (FIG. 22) can be provided in the fluid pathway between the push-push valve 260 and the auxiliary fluid distributor 194 which is configured to close when the extraction cleaner 10 in placed in the upright or storage position.

Figure 21:
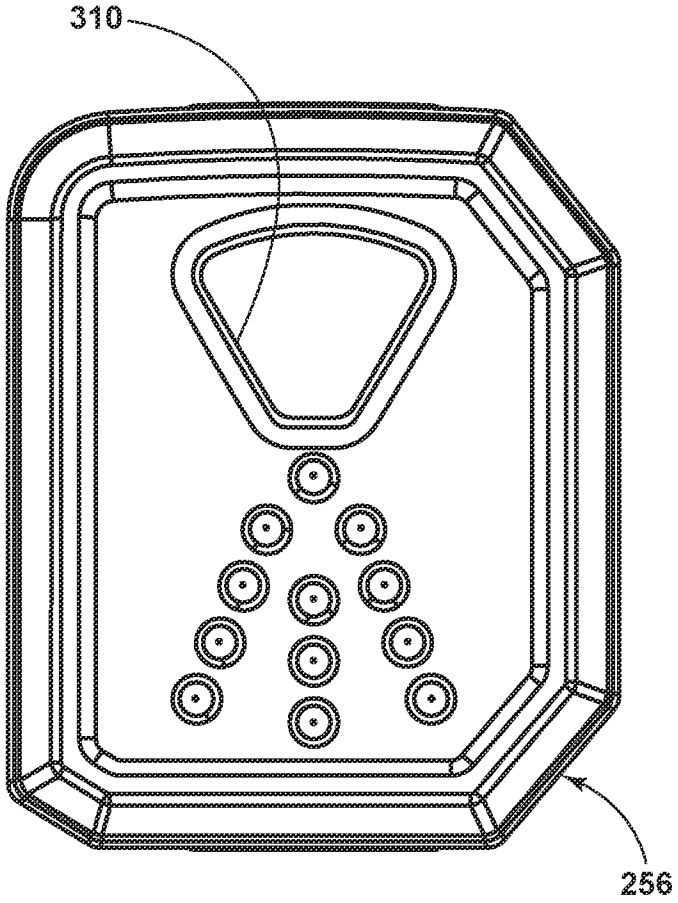
FIG. 21 is a top view of the control pedal for the valve of FIG. 16.
Figure 20:
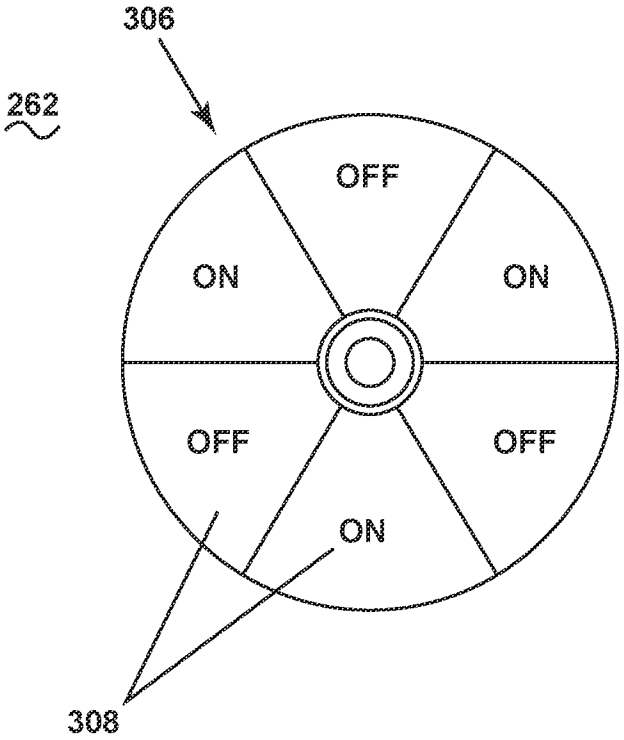
FIG. 20 is a top view of an indicator wheel for the valve of FIG. 16.

FIGS. 20-21 show one example of the status indicator 262 that can be provided on the control pedal 256 to indicate to the user whether fluid is spraying from the auxiliary fluid distributor 194 or not. The status indicator 262 can include an indicator wheel 306 coupled with an upper end of the plunger 270 and lying underneath the control pedal 256. The indicator wheel 306 is fixed with the plunger 270, such that it will rotate as the plunger 270 rotates. The indicator wheel 306 includes discrete sections 308 that are rotated past a window or cutout 310 in the control pedal 256. A user can view the indicator wheel 306 through the window or cutout 310. In the example shown, the indicator wheel 306 is divided into 6 equal sections 308, which alternate between an "on" indication, which indicates the open valve position, and an "off" indication, which indicates the closed valve position. The sections 308 of the indicator wheel 306 can be provided with text (such as, but not limited to, "ON" and "OFF") or different colors (such as, but not limited to, green and red), or any combination of both, to indicate the open and closed positions of the valve 260. In another example not illustrated herein, the status indicator 262 can include a light on the control pedal 256 that will illuminate one color, such as green, when fluid is spraying, and another color, such as red, when there is no spray.

FIG. 22 is a schematic view of the fluid delivery system 12 of the extraction cleaner 10. The outlet of the supply container 34 is coupled to a receiver valve assembly 312 with two outlets to feed the pump 40 and the primary fluid distributor 192, which is gravity-fed. The conduit 202 feeding the primary fluid distributor 192 includes the flow controller assembly 254, which in this example includes an adjustable valve that permits varied flow rate operation. The pathway extending from the outlet of the pump 40 branches into two separate conduits 246, 314, one conduit 246 feeding the auxiliary fluid distributor 194 and one conduit 314 feeding the vacuum hose 28 via the diverter 32. When the vacuum hose 28 is not installed and the pedal 256 is not pressed, the pump 40, which in this example is a centrifugal pump, operates in a "dead-head" condition, meaning the pump 40 continues to operate, but fluid is recirculated within the pump 40. Various combinations of optional components can be incorporated into the fluid delivery system such as a heater, additional supply tanks, and/or additional fluid control and mixing valves.

Figure 23:
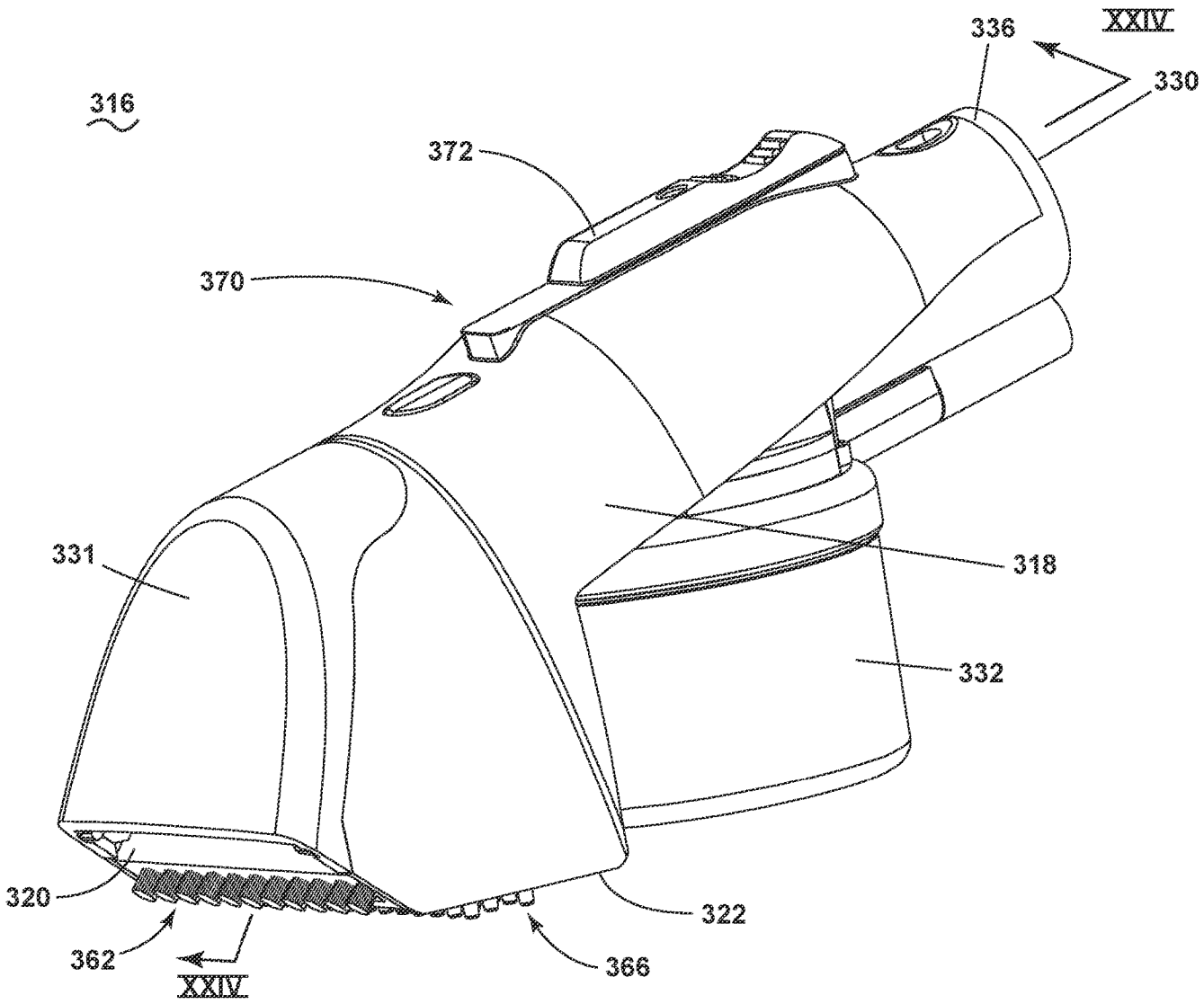
FIG. 23 is a perspective view of a portion of hand-held wet/dry accessory tool according to aspects of the present disclosure.

FIG. 23 is a perspective view of a portion of hand-held wet/dry accessory tool 316 according to a third example of the present disclosure. The hand-held wet/dry accessory tool 316 can be used with an extraction cleaner, such as but not limited to any example of the extraction cleaner 10 disclosed herein, and can be coupled with an extraction cleaner by a conduit, such as the vacuum hose 28. Furthermore, the accessory tool 316 can be utilized with other vacuum cleaning appliances.

The accessory tool 316 comprises a fluid delivery system for delivering cleaning fluid to a surface to be cleaned and a fluid recovery system for removing the spent cleaning fluid and dirt from the surface to the cleaned. The fluid recovery system can further store at least some of the recovered cleaning fluid and dirt, including dry dirt and debris, onboard the tool. The fluid delivery and recovery systems of the accessory tool 316 are configured to couple with the fluid delivery and recovery systems of the extraction cleaner to which the tool is coupled.

The accessory tool 316 comprises a tool body 318 that carries or includes a wet suction nozzle 320 and a dry suction nozzle 322 that is separate from the wet suction nozzle 320. Each nozzle 320, 322 has a nozzle inlet 324, 326, with the wet suction nozzle inlet 324 being forward of the dry suction nozzle inlet 326, relative to the user gripping the tool 316 in the normal fashion. The wet suction nozzle inlet 324 can be fluidly isolated from the dry suction nozzle inlet 326, such that the suction pathways through each nozzle 320, 322 are initially separate but can converge downstream into a common suction pathway defined by a working air conduit 328. In the illustrated example, the suction pathways can converge within the accessory tool 316, for example at or before a downstream end 330 of the tool body 318 that couples with the vacuum hose 28. The wet suction nozzle 320 can be at least partially defined by a removable nozzle cover 331 attached at the front of the tool body 318.

The accessory tool 316 further includes a collection chamber or dirt cup 332 removably supported at a lower portion of the tool body 318, lower being defined as relative to the typical use position of the accessory tool 316, behind the suction nozzles 320, 322. The dirt cup 332 is in fluid communication with the dry suction nozzle 322 and stores dirt recovered by the dry suction nozzle 322. In the illustrated example, any cleaning fluid and/or dirt recovered by the wet suction nozzle 320 is not received in the dirt cup 332, but rather is received by the recovery container 20 of the extraction cleaner 10.

Figure 24:
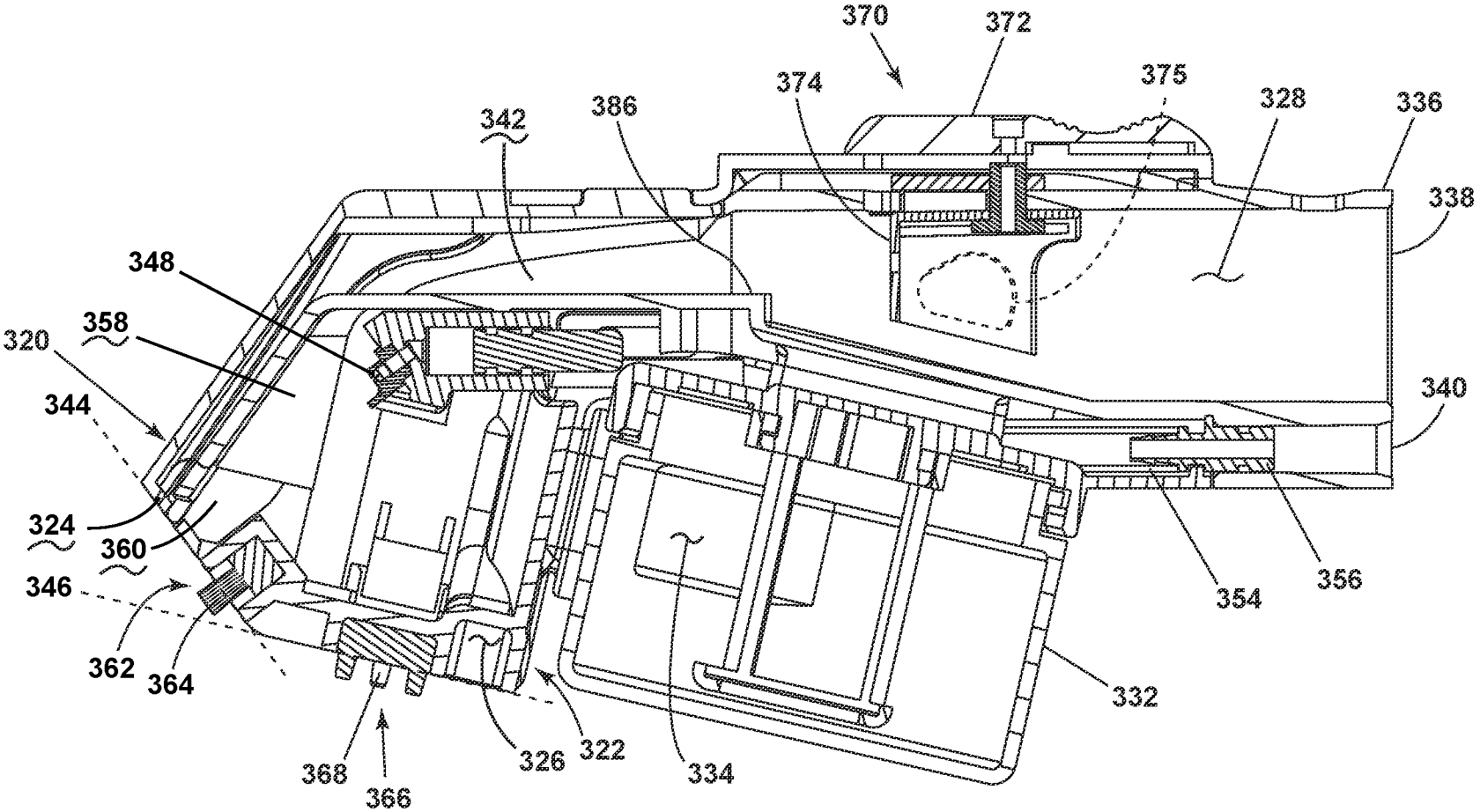
FIG. 24 is a cross-sectional view through a centerline of the hand-held wet/dry accessory tool from FIG. 23.

FIG. 24 is a cross-sectional view through the center of the hand-held wet/dry accessory tool 316 from FIG. 23. The dirt cup 332 can further comprise a cyclone separator 334 for separating fluid and entrained dirt from the working airstream. The cyclone separator 334 can have a single cyclonic separation stage, or multiple stages. Dirt separated by the cyclone separator 334 is collected in the dirt cup 332, which can be removed from the tool 316 for emptying. In another conventional arrangement, the accessory tool 316 can include an integrally formed cyclone separator and dirt cup, with the dirt cup being provided with a bottom-opening dirt door for contaminant disposal. It is understood that other types of collection systems can be used, such as centrifugal separators or bulk separators. In yet another conventional arrangement, the collection system can include a filter bag.

The accessory tool 316 is adapted to be hand-held, and includes a hose connector 336 at one end of the tool body 318 that can be sized to be gripped by one hand of the user. The hose connector 336 includes a working air conduit opening 338 and a fluid opening 340. A working air conduit 342 is formed through the tool body 318 and extends between the wet suction nozzle inlet 324 and the working air conduit opening 338, and is partially defined by the common working air conduit 328.

The hose connector 336 can be angled relative to the forward portion of the tool body 318, such that when the nozzle inlets 324, 326 are placed on a surface to be cleaned in the normal operating position, the hose connector 336 extends at an acute angle to the surface. This positions the tool 316 in a comfortable ergonomic orientation during use. It is further noted that the wet and dry suction nozzle inlets 324, 326 are provided on different planes 344, 346 of the tool body 318, so that the user can selectively bring the wet suction nozzle 320 or the dry suction nozzle 322 into contact with the surface to be cleaned by pivoting the tool 316, such as in a generally forwardly or rearwardly direction about an axis generally perpendicular to the extension direction of the hose connector 336. However, it is noted that the wet suction nozzle inlet 324 and dry suction nozzle inlet 326 could be provided the same plane of the tool body 318.

The tool body 318 further includes a fluid distributor 348 at a forward portion of the body 318, between the wet and dry suction nozzles 320, 322. The fluid distributor 348 comprises an outlet configured to dispense fluid onto the surface to be cleaned, and an inlet in fluid communication with the fluid dispensing system of the extraction cleaner 10 via a conduit 354. The conduit 354 can extend through the tool body 318, and can include, as illustrated herein, a flexible tubing connecting the inlet of the fluid distributor 348 with a fluid coupler 356 at the fluid opening 340 of the hose connector 336. The other end of the fluid coupler 356 is adapted to couple with a fluid connector of the vacuum hose 28 coupled with the hose connector 336.

In the illustrated example, the fluid distributor 348 includes a spray nozzle positioned within a fluid distributor chamber 358 that is open to the surface to be cleaned, and which includes a fluid outlet 360 adjacent the wet nozzle suction inlet 324 through which fluid can be dispensed onto the surface. Other configurations for the fluid distributor 348 are possible, including fluid distributors with more than one outlet configured to dispense fluid onto the surface to be cleaned.

The tool body 318 further includes one or more agitator(s) for scrubbing or otherwise agitating the surface to be cleaned. In the illustrated example, a first agitator 362 in the form of a row of bristle tufts, each including a plurality of bristles 364, is provided between the wet and dry suction nozzles 320, 322 and rearwardly of the fluid outlet 360 in the tool body 318. A second agitator 366 in the form of a plurality of elastomeric hair collector nubs 368, is provided rearwardly of the first agitator 362 and in front of the dry suction nozzle 322.

The bristles 364 and the hair collector nubs 368 are provided on different planes 344, 346 of the tool body 318, so that the user can selectively bring the bristles 364 or the hair collector nubs 368 into contact with the surface to be cleaned by pivoting the tool 316, such as in a generally forwardly or rearwardly direction about an axis generally perpendicular to the extension direction of the hose connector 336. The bristles 364 can be provided on substantially the same plane 344 as the wet suction nozzle inlet 324 and the hair collector nubs 368 are provided on substantially the same plane 346 as the dry suction nozzle inlet 326. As such, pivoting the tool 316 to use the wet suction nozzle inlet 324 brings the bristles 364 into engagement with the surface to be cleaned, and pivoting the tool 316 to use the dry suction nozzle inlet 326 brings the nubs 368 into engagement with the surface to be cleaned. This may be preferable since the nubs 368 are more effective at lifting dry hair off dry upholstery and carpet, whereas bristles 364 are more effective at agitating and removing stains from upholstery and carpet during an extraction cleaning process.

The tool body 318 further includes a diverter 370 fluidly connected to the separate wet and dry suction nozzles 320, 322 to selectively divert the tool 316 between a wet cleaning mode and a dry cleaning mode. The diverter 370 includes a movable diverter body 374 positioned within the common working air conduit 328 and a diverter actuator 372 coupled with the diverter body 374. The diverter actuator 372 can be provided on an exterior of the tool body 318 such that the user can engage the diverter actuator 372 to move the diverter body 374 between the wet and dry cleaning mode positions. The diverter body 374 can be a plug or other structural element configured to selectively divert suction through either the wet suction nozzle inlet 324 or the dry suction nozzle inlet 326 as described in more detail below.

The diverter actuator 372 can be slidably mounted on the exterior of the tool body 318 and movable between a forward and rearward position, and is shown in the example herein as a sliding button. In addition to the diverter body 374, the actuator 372 is operably coupled with a valve actuator 376 inside the tool body 318, which moves together with the diverter actuator 372.

The valve actuator 376 is further operably connected to a fluid shut-off valve 378 that is fluidly connected upstream from the fluid distributor 348 for selectively blocking the liquid delivery path when the tool 316 is used in dry mode. This configuration prevents a user from inadvertently spraying fluid during dry vacuuming mode. The valve actuator 376 comprises an actuator link 380, which may be a slotted link, that is interconnected to a plunger 382 of the shut-off valve 378 and configured to push the plunger 382 relative to a valve body 384 into the valve closed position when the diverter actuator 372 is moved to the forward, or dry cleaning position, and to pull the plunger 382 to the valve open position when the diverter actuator 372 is moved to the rearward, or wet cleaning position.

The accessory tool 316 with the diverter 370 disclosed herein permits a user to pick up large dry debris with the extraction cleaner 10, instead of the typical process of using a separate vacuum cleaner to dry vacuum the surface to be cleaned prior to operating the extraction cleaner for wet cleaning. In addition, the valve actuator 376 disclosed herein prevents inadvertent distribution of fluid onto a surface being cleaned while the accessory tool 316 is used to pick up dry debris.

Figure 25A:
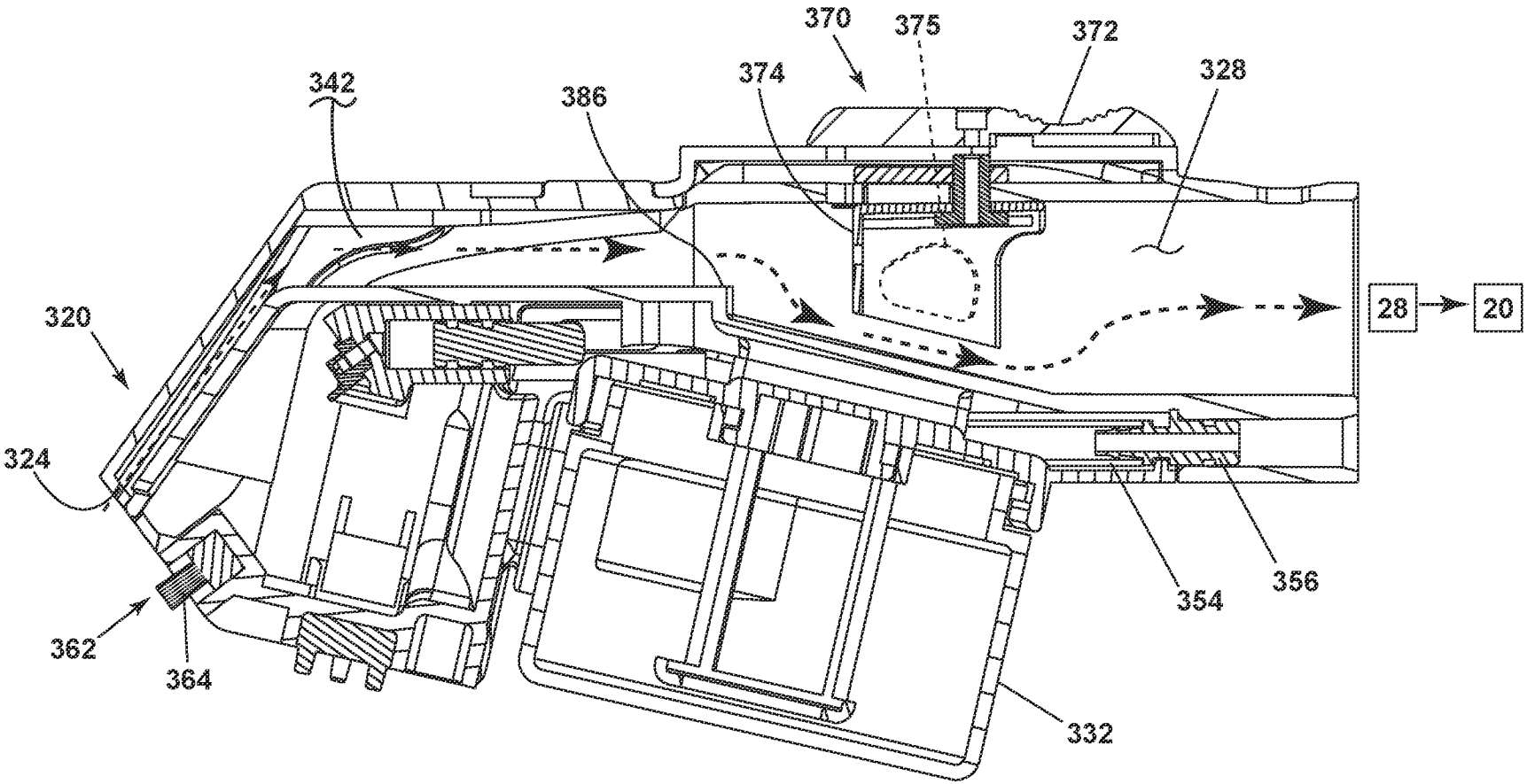
FIG. 25A is a cross-sectional view similar to FIG. 24, showing a recovery pathway of the accessory tool during a wet mode of operation.
Figure 25C:
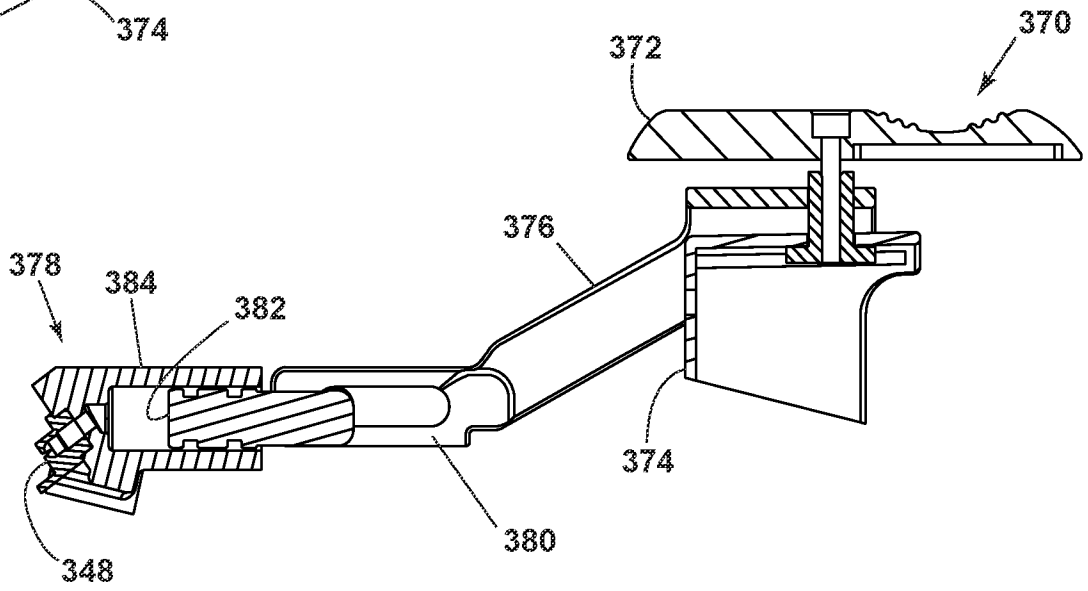
FIG. 25C is a cross-sectional view of the diverter and fluid shut-off valve assembly of FIG. 25B.
Figure 25B:
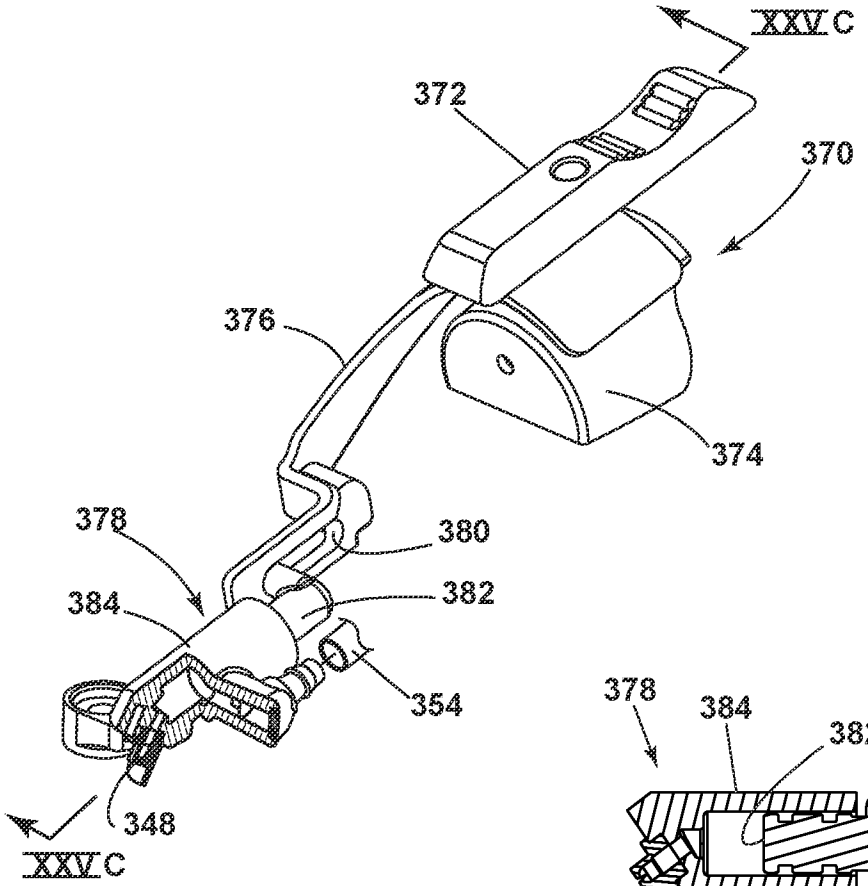
FIG. 25B is a partial perspective and cut-away view of a diverter and fluid shut-off valve assembly of the wet/dry accessory tool in a wet mode of operation.

In the wet cleaning mode shown in FIGS. 25A-25C, the diverter actuator 372 is in the rearward position, which moves the diverter body 374 rearwardly so that all or a majority of the suction force and airflow is drawn at the wet suction nozzle 320. When a user slides the diverter 370 rearwardly to the wet cleaning mode position, the diverter body 374 closes off the dry suction pathway by blocking an outlet 375 of the dry suction nozzle 322, and wet debris can be ingested through the wet suction nozzle 320. Additionally, the shut-off valve 378 is in the open position so that fluid is free to flow through the valve 378 and can be distributed through the fluid distributor 348 onto the surface to be cleaned.

Figure 26A:
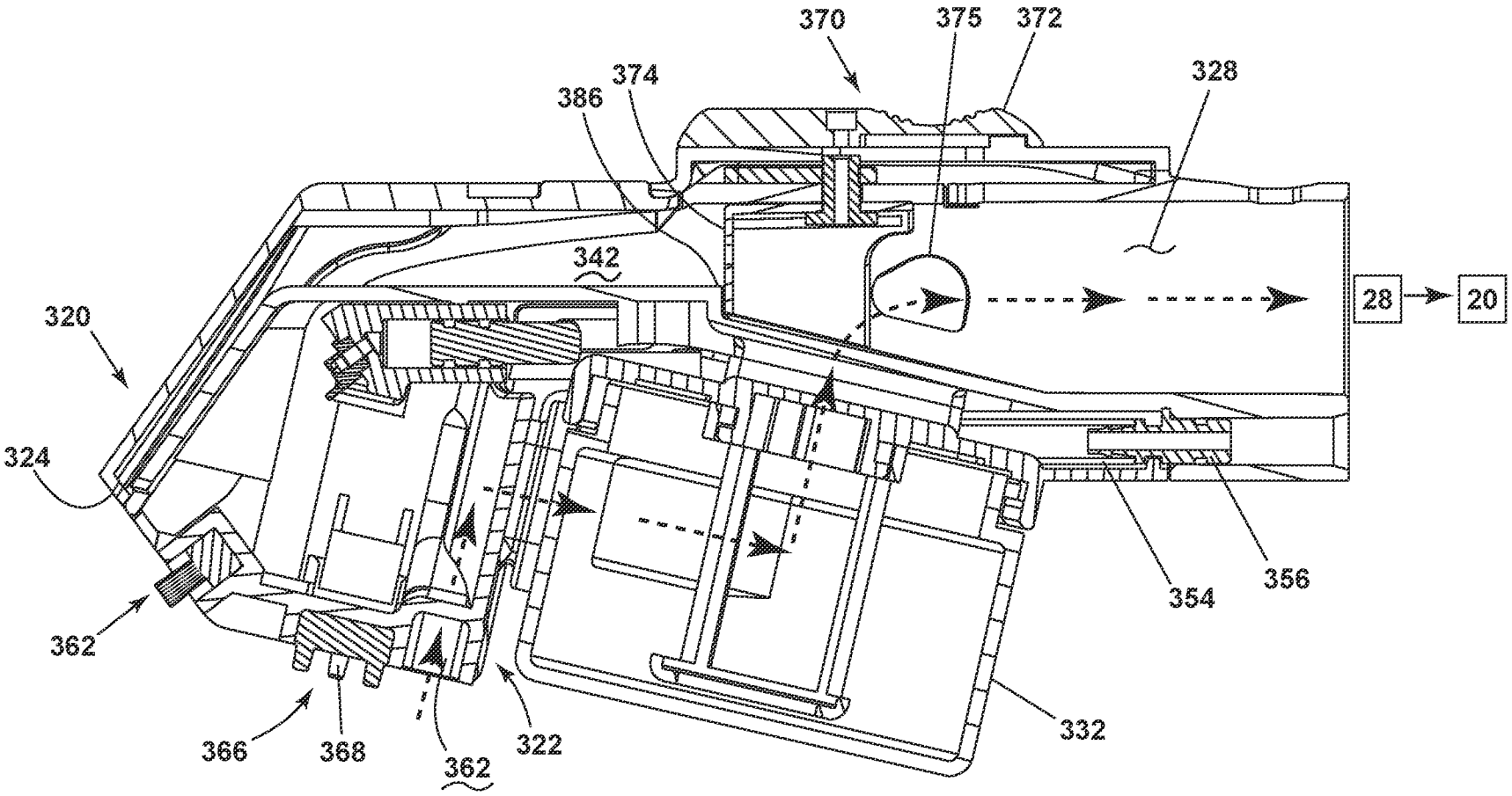
FIG. 26A is a cross-sectional view similar to FIG. 24, showing a recovery pathway of the accessory tool during a dry mode of operation.
Figure 26B:
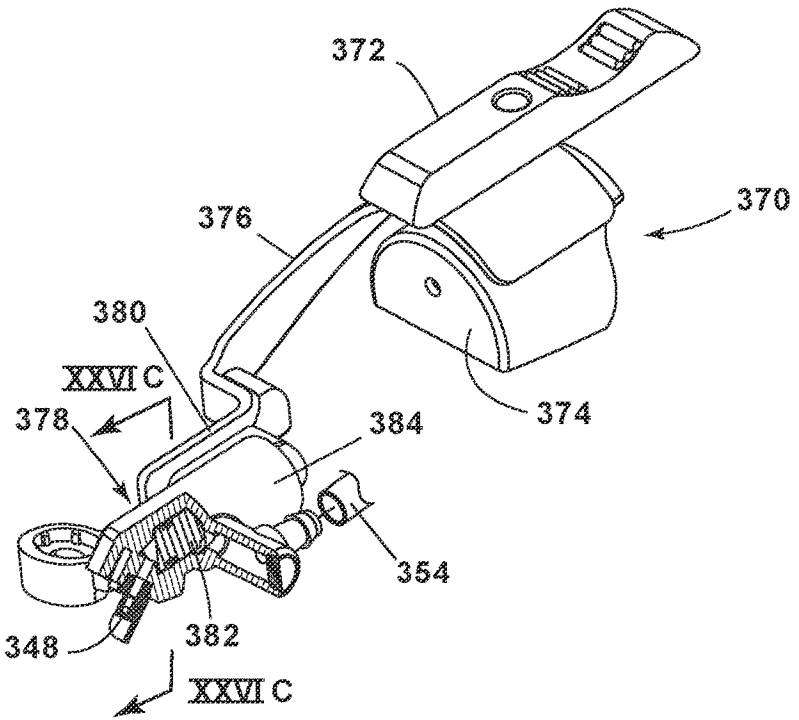
FIG. 26B is a partial perspective and cut-away view of a diverter and fluid shut-off valve assembly of the wet/dry accessory tool in a dry mode of operation.
Figure 26C:
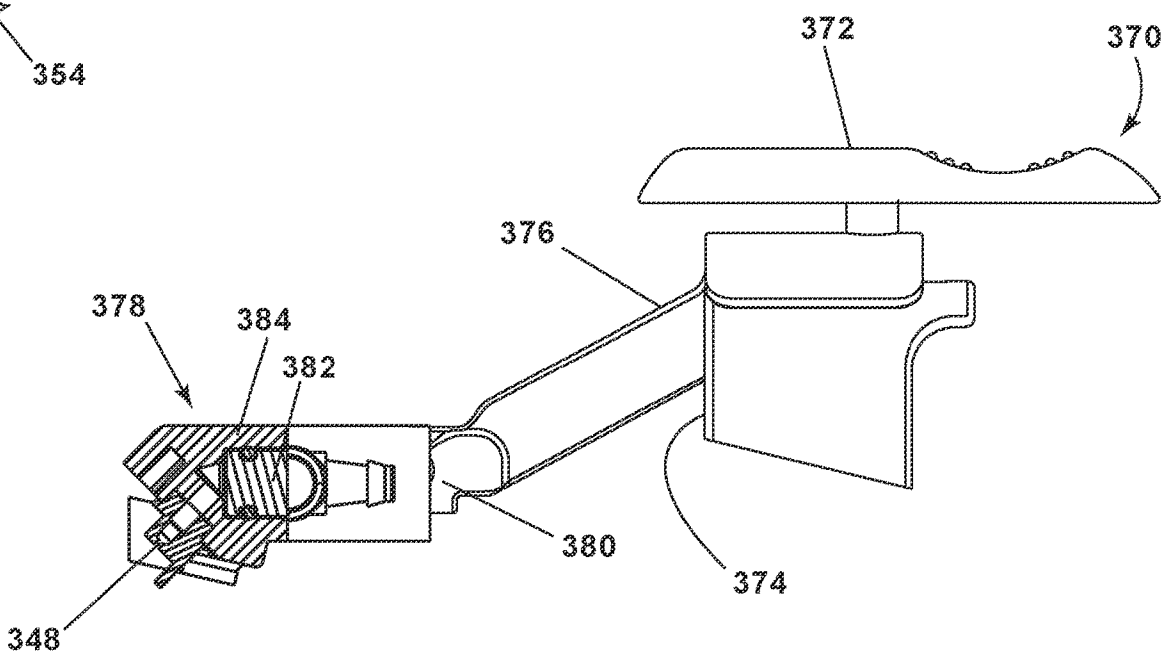
FIG. 26C is a cross-sectional view of the diverter and fluid shut-off valve assembly of FIG. 26B.
Figure 27:
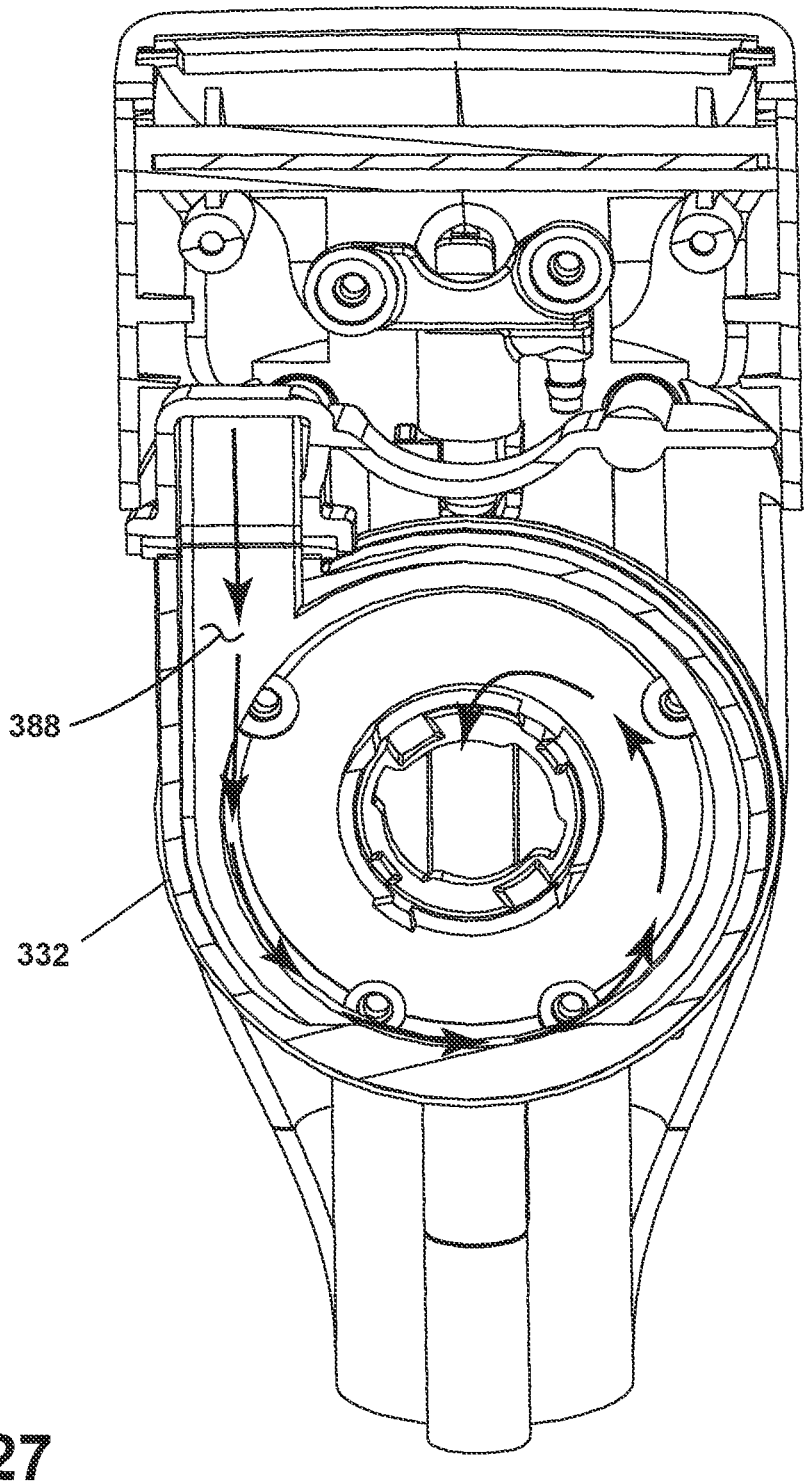
FIG. 27 is a sectional view through a collection chamber of the accessory tool, showing a recovery pathway during a dry mode of operation.

In the dry cleaning mode shown in FIGS. 26A-27, the diverter actuator 374 is in the forward position, which moves the diverter body 374 forward so that all or a majority of the suction force and airflow is drawn at the dry suction nozzle 322. When a user slides the diverter 370 forwardly to the dry cleaning mode position, the diverter body 374 unblocks the outlet 375 of the dry suction nozzle 322 thereby opening the dry suction pathway and closes off the wet suction pathway by blocking an outlet 386 of the working air conduit. Thus, dry debris can be ingested through the dry suction nozzle 322 and collected in the dirt cup 332. Additionally, the shut-off valve 378 is in the closed position so that fluid is blocked from flowing through the fluid distributor 348 onto the surface to be cleaned.

In operation, when a user slides the diverter 370 rearwardly to the wet cleaning mode shown in FIGS. 25A-25C, wet mode, wet debris (including liquid, air, and debris) can be ingested through the wet suction nozzle 324 on the front of the tool 316 and up into the working air conduit 342. After passing the diverter body 374 and through the common working air conduit 328, the wet debris moves through the hose 28 coupled between the tool 316 and the extraction cleaner 10, and is deposited into the main recovery container 20 of the extraction cleaner 10. In the wet cleaning mode, the diverter 370 also moves the valve actuator 376 rearwardly such that the actuator link 380 pulls the valve plunger 382 away from the valve body 384, thereby opening the valve 378. Thus a fluid flow path is opened through the valve body 384 to the fluid distributor 348.

In operation, when a user slides the diverter 370 to the dry cleaning mode shown in FIGS. 26A-27, dry debris (including air and debris) can be ingested through the dry suction nozzle 322 and is transported through the cyclonic separator 334 and deposited in the dirt cup 332 beneath the separator 334. A filter material (not shown) can be provided in the dirt cup 332 and removes dry debris from the working air flow. A tangential inlet 388 on the dirt cup 332 causes a cyclonic effect before the debris is separated from the air by the filter.

Substantially all debris is separated and collected by the tool, aside from some fine dust, which may pass through the filter material and flow into the downstream recovery system of the extraction cleaner 10. Air then passes up into the common working air conduit 328, through the hose 28 coupled between the tool 316 and on to the extraction cleaner 10.

In the dry cleaning mode, the diverter 370 moves the valve actuator 376 forwardly and the actuator link 380 pushes the valve plunger 382 into the valve body 384, thereby closing the valve 378. Thus the fluid flow path between the valve body 384 and the fluid distributor 348 is blocked so that inadvertent spraying of liquid is prevented in dry cleaning mode.

With this diversion mechanism, the accessory tool 316 permits a user to pick up large dry debris with the extraction cleaner 10 instead of having to separately vacuum the surface to be cleaned prior to operating the extraction cleaner 10, which is the typical process. It is noted that in the dry cleaning mode, a small suction force may still be drawn at the wet suction nozzle inlet 324 but a much larger suction force is drawn at the dry suction nozzle inlet 326. Since the diverter 370 slides axially inside of the handle part or hose connector 336 of the tool body 318, a small amount of clearance is needed between the diverter 370 and the hose connector 336, and the clearance causes a small air leak. Thus, there is a small amount of suction that will be drawn at the wet suction nozzle 320 when the diverter 370 is in the dry position. Likewise, in the wet cleaning mode, a small suction force may still be drawn at the dry suction nozzle inlet 326 due to the aforementioned air leak at the diverter 370, but a much larger suction force is drawn at the wet suction nozzle inlet 324.

While the various examples illustrated herein show an upright extraction cleaner, for example FIG. 2, aspects of the present disclosure may be used on other types of extraction cleaners, including, but not limited to, a canister device having a cleaning implement connected to a wheeled base by a vacuum hose, a portable extractor adapted to be hand carried by a user for cleaning relatively small areas, an autonomous or robotic extraction cleaner, or a commercial extractor. For example, any of the examples can be combined with an extraction cleaner as generally outlined with respect to FIG. 1. Still further, aspects of the present disclosure may also be used on surface cleaning apparatus other than extraction cleaners, such as a vacuum cleaner or steam cleaner. A vacuum cleaner typically does not deliver or extract liquid, but rather is used for collecting relatively dry debris (which may include dirt, dust, stains, soil, hair, and other debris) from a surface. A steam cleaner generates steam for delivery to the surface to be cleaned, either directly or via cleaning pad. Some steam cleaners collect liquid in the pad, or may extract liquid using suction force. Furthermore, the hand-held wet/dry accessory tool of FIG. 23 may be applicable to extraction cleaners other than those described with respect to FIG. 1 and FIG. 2.

To the extent not already described, the different features and structures of the various examples of the present disclosure, may be used in combination with each other as desired, or may be used separately. That one extraction cleaner is illustrated herein as having all of these features does not mean that all of these features must be used in combination, but rather done so here for brevity of description. Furthermore, while the extraction cleaner shown herein is upright, some features of the present disclosure can be useful on a canister, stick, handheld, portable, or autonomous cleaner. Still further, the extraction cleaner can additionally have steam delivery capability. Thus, the various features of the different embodiments may be mixed and matched in various vacuum cleaner configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus comprising:

a base assembly adapted for movement across a surface to be cleaned;

an upright assembly pivotally connected to the base assembly to direct the base assembly across the surface to be cleaned; and a fluid recovery system comprising a suction source, a suction nozzle provided on the base assembly in fluid communication with the suction source, and a recovery container;

the base assembly comprising:

a base housing;

a brush chamber including a rear wall defining a rear of the brush chamber, a top wall defining a top of the brush chamber, and a front wall defining a front of the brush chamber, the front wall and the rear wall extending downwardly from the top wall;

at least one brushroll in the brush chamber; and a brush housing releaseably attached to the base housing, the brush housing removable to access the at least one brushroll;

wherein the rear wall of the brush chamber is attached to and removable with the brush housing, and wherein the rear wall extends downwardly further than a rotational axis of the at least one brushroll rearward of a middle of the at least one brushroll when the brush housing is attached to the base housing.

2. The surface cleaning apparatus of claim 1, wherein the top, rear, and front walls are removable with the brush housing.

3. The surface cleaning apparatus of claim 2, wherein the suction nozzle overlies the top and front walls.

4. The surface cleaning apparatus of claim 1, further comprising:

a fluid supply container to store a supply of cleaning fluid;

a fluid distributor in fluid communication with the fluid supply container and disposed on the brush housing such that the fluid distributor is removable from the base assembly with the brush housing.

5. The surface cleaning apparatus of claim 4, wherein the brush housing includes a first fluid coupler in fluid communication with the fluid distributor and the base housing includes a corresponding second fluid coupler, the first and second fluid couplers configured to engage upon mounting of the brush housing to the base housing and to decouple upon removal of the brush housing from the base housing.

6. The surface cleaning apparatus of claim 4, wherein when the brush housing is mounted to the base housing, the fluid distributor is disposed within the brush chamber and located above the at least one brushroll.

7. The surface cleaning apparatus of claim 4, wherein the fluid distributor dispenses cleaning fluid onto the at least one brushroll.

8. The surface cleaning apparatus of claim 4, wherein the fluid distributor is a first fluid distributor, and further comprising a second fluid distributor in fluid communication with the fluid supply container, wherein the second fluid distributor dispenses cleaning fluid directly onto the surface to be cleaned and is located on the base assembly forwardly of the first fluid distributor.

9. The surface cleaning apparatus of claim 4, further comprising a heater in fluid communication with the fluid supply container to heat cleaning fluid supplied to the fluid distributor.

10. The surface cleaning apparatus of claim 1, wherein the suction nozzle comprises a front wall, a rear wall, and a suction pathway formed between the front wall and the rear wall, the suction nozzle being releaseably connected to the base assembly.

11. The surface cleaning apparatus of claim 10, wherein the base assembly includes a recovery airflow conduit, wherein the suction pathway connects to the recovery airflow conduit when the suction nozzle is connected to the base assembly and is disconnected and spaced from the recovery airflow conduit when the suction nozzle is disconnected from the base assembly, and the suction nozzle communicates with the recovery container via the recovery airflow conduit while the suction nozzle is connected to the base assembly.

12. The surface cleaning apparatus of claim 10, wherein the suction nozzle is removable from the base assembly separately from the brush housing, the suction nozzle configured to conceal a portion of the brush housing upon mounting of the suction nozzle to the base assembly and to expose the portion of the brush housing upon removal of the suction nozzle from the base assembly.

13. The surface cleaning apparatus of claim 1, wherein the suction nozzle is disposed over at least a portion of the brush housing.

14. The surface cleaning apparatus of claim 1, wherein the at least one brushroll comprises dual horizontally-rotating brushrolls.

15. The surface cleaning apparatus of claim 1, wherein the upright assembly includes a frame supporting the recovery container and a fluid supply container, an elongated handle extending upwardly from the frame, and a hand grip at an end of the elongated handle opposite the frame.

16. The surface cleaning apparatus of claim 1, wherein the rear wall extends downwardly further than the front wall at the middle of the at least one brushroll when the brush housing is attached to the base housing.

17. The surface cleaning apparatus of claim 1, wherein the rear wall extends a length of the at least one brushroll.

18. The surface cleaning apparatus of claim 1, wherein one of the base housing or the brush housing comprises a slot and the other of the base housing or the brush housing comprises a corresponding protrusion aligned with and received in the slot when the brush housing is attached to the base housing.

19. The surface cleaning apparatus of claim 18, wherein the slot is tapered inwardly such that the slot narrows in a direction away from an entrance of the slot at which the corresponding protrusion is received into the slot.

20. A surface cleaning apparatus comprising:

a base assembly adapted for movement across a surface to be cleaned;

an upright assembly pivotally connected to the base assembly to direct the base assembly across the surface to be cleaned; and a fluid supply container to store a supply of cleaning fluid;

a fluid distributor in fluid communication with the fluid supply container to dispense cleaning fluid, the fluid distributor located on the base assembly; and a flow control actuator configured to control a flow of cleaning fluid from the fluid supply container to the fluid distributor;

a fluid recovery system comprising a suction source, a suction nozzle provided on the base assembly in fluid communication with the suction source, and a recovery container;

the base assembly comprising:

a base housing;

a brush chamber including a rear wall defining a rear of the brush chamber, a top wall defining a top of the brush chamber, and a front wall defining a front of the brush chamber, the front wall and the rear wall extending downwardly from the top wall;

at least one brushroll in the brush chamber;

a brush housing releaseably attached to the base housing, the brush housing removable to access the at least one brushroll; wherein the rear wall extends downwardly further than the front wall at the middle of the at least one brushroll when the brush housing is attached to the base housing; and wherein the fluid distributor and the rear wall of the brush chamber are attached to and removable with the brush housing.

* * * * *